US010451991B2

(12) United States Patent
Nagata et al.

(10) Patent No.: US 10,451,991 B2
(45) Date of Patent: Oct. 22, 2019

(54) IMAGE FORMING APPARATUS

(71) Applicant: CANON KABUSHIKI KAISHA, Tokyo (JP)

(72) Inventors: Teppei Nagata, Abiko (JP); Toru Kabashima, Moriya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/556,348

(22) PCT Filed: May 27, 2016

(86) PCT No.: PCT/JP2016/066511
§ 371 (c)(1),
(2) Date: Sep. 7, 2017

(87) PCT Pub. No.: WO2016/190447
PCT Pub. Date: Dec. 1, 2016

(65) Prior Publication Data

US 2018/0107130 A1 Apr. 19, 2018

(30) Foreign Application Priority Data

May 27, 2015 (JP) ..... 2015-107898

(51) Int. Cl.
*G03G 9/125* (2006.01)
*G03G 15/10* (2006.01)
*G03G 21/10* (2006.01)

(52) U.S. Cl.
CPC ..... *G03G 9/125* (2013.01); *G03G 15/104* (2013.01); *G03G 21/10* (2013.01); *G03G 15/105* (2013.01)

(58) Field of Classification Search
CPC ..... G03G 9/12; G03G 9/125; G03G 9/135; G03G 15/10; G03G 15/11; G03G 15/104; G03G 15/105
See application file for complete search history.

(56) References Cited

U.S. PATENT DOCUMENTS 5,231,454 A 7/1993 Landa
5,346,796 A * 9/1994 Almog ..... G03G 9/135 430/114

(Continued)

FOREIGN PATENT DOCUMENTS

JP 2000-019852 A 1/2000
JP 2000-214687 A 8/2000

(Continued)

OTHER PUBLICATIONS

JP 2000019852 English machine translation, Makii, Jan. 21, 2000.*

(Continued)

*Primary Examiner* — Carla J Therrien
(74) *Attorney, Agent, or Firm* — Venable LLP

(57) ABSTRACT

An image forming apparatus includes an image forming portion configured to form an image with a liquid developer containing a toner and a carrier liquid, a separating device configured to separate the toner and the carrier liquid from the liquid developer collected at the image forming portion, a first carrier supplying device supplies a first carrier liquid separated by the separating device, and a second carrier supplying device including a second carrier container to accommodate a second carrier liquid in which a ratio of the first substance to the second substance is smaller than that in the first carrier liquid separated by the separating device or no first substance is contained. An accommodating portion accommodates the liquid developer including the first carrier liquid, the second carrier liquid, and the toner, wherein the (Continued)

liquid developer accommodated in the accommodating portion is supplied to the image forming portion.

19 Claims, 18 Drawing Sheets

(56) References Cited

U.S. PATENT DOCUMENTS

| | | | | |
|---|---|---|---|---|
| 5,987,273 | A | 11/1999 | Yamamoto | |
| 6,776,099 | B1 | 8/2004 | Landa et al. | |
| 8,331,833 | B2 | 12/2012 | Akita et al. | |
| 8,383,314 | B2 | 2/2013 | Shoshi et al. | |
| 2008/0205935 | A1* | 8/2008 | Oda | G03G 15/104 399/250 |
| 2009/0226839 | A1* | 9/2009 | Teishev | G03G 9/125 430/115 |
| 2015/0268590 | A1* | 9/2015 | Sakamoto | G03G 15/11 399/237 |
| 2018/0059582 | A1* | 3/2018 | Nagata | G03G 15/105 |

FOREIGN PATENT DOCUMENTS

| | | | |
|---|---|---|---|
| JP | 3105836 | B2 | 11/2000 |
| JP | 2003-509706 | A | 3/2003 |
| JP | 2008-083348 | A | 4/2008 |
| JP | 2008-242436 | A | 10/2008 |
| JP | 4230146 | B2 | 2/2009 |
| JP | 2010-032689 | A | 2/2010 |
| JP | 2011-022554 | A | 2/2011 |
| JP | 2011-095377 | A | 5/2011 |
| JP | 2011-175210 | A | 9/2011 |
| JP | 2014-203066 | A | 10/2014 |
| RU | 2402054 | C2 | 6/2008 |
| WO | 2004/017145 | A1 | 2/2004 |

OTHER PUBLICATIONS

Notification of Transmittal of the International Search Report and the Written Opinion dated Aug. 23, 2016, in International Application No. PCT/JP2016/066511.

Teppei Nagata et al., U.S. Appl. No. 15/556,683, filed Sep. 8, 2017.

Kotaro Torikata, U.S. Appl. No. 15/558,299, filed Sep. 28, 2017.

Office Action in Russian Patent Application No. 2017135421, dated Jul. 23, 2018.

Korean Office Action dated Oct. 29, 2018, in related Korean Patent Application No. 10-2017-7036344.

European Search Report dated Jan. 4, 2019, in related European Patent Application No. 16800151.9.

Japanese Office Action dated Feb. 12, 2019, in related Japanese Patent Application No. 2015-107898.

* cited by examiner

IMAGE FORMING APPARATUS

TECHNICAL FIELD

The present invention relates to an electrophotographic image forming apparatus, including a separating device, for forming an image with the liquid developer, and relates to the separating device for separating a toner and a carrier liquid from a liquid developer.

BACKGROUND ART

Conventionally, the image forming apparatus for forming the image with the liquid developer containing the toner and the liquid developer has been known. In the image forming apparatus, the liquid developer which is not used in an image forming step is collected and recycled. In such a recycling process of the liquid developer, toner particles which are a dispersed in the liquid developer (liquid material) and the carrier liquid which is a dispersion medium in the liquid developer are separated, and then the carrier liquid is used again (for example, Japanese Laid-Open Patent Application 2008-242436).

However, by repeating recycling, in the carrier liquid, a substance having a low volume resistivity accumulates. Thus, a resistance of an entirety of the liquid developer lowers, so that there is a liability that an image defect generates. By periodically exchanging (replacing) a container accommodating the liquid developer, the generation of the image defect can be suppressed, but in this case, a running cost increases, as does the maintenance load required by a user or a service person.

SUMMARY OF THE INVENTION

The present invention has been accomplished in view of the above-described circumstances and a principal object of the present invention is to replace a constitution capable of suppressing a lowering in volume resistivity of a collect to be reused.

According to an aspect of the present invention, there is provided an image forming apparatus comprising: an image forming portion configured to form an image with a liquid developer containing a toner and a carrier liquid, wherein the carrier liquid contains a first substance for imparting an electrical polarity and a second substance, higher in volume resistivity than the first substance, as a dispersion medium for dispersing the toner; a separating device configured to separate the toner and the carrier liquid from the liquid developer collected at the image forming portion; a first carrier supplying device, including a first container capable of accommodating the carrier liquid separated from the separating device, capable of supplying the carrier liquid out of the first container; a second carrier supplying device including a second container configured to accommodate the carrier liquid in which a ratio of the first substance is smaller than that in the carrier liquid collected from the separating device or no first substance is contained, wherein the second carrier supplying device is capable of supplying the carrier liquid out of the second container; and an accommodating portion configured to accommodate the carrier liquid supplied from the first carrier supplying device and the carrier liquid supplied from the second carrier supplying device, wherein the carrier liquid accommodated in the accommodating portion is capable of being supplied to the image forming portion.

According to another aspect of the present invention, there is provided an image forming apparatus according to Claim 1, further comprising a resistance detecting device configured to detect a volume resistivity of a liquid in the accommodating portion, wherein the second carrier supplying device is capable of supplying the carrier liquid from the second container to the accommodating portion and supplies the carrier liquid to the accommodating portion on the basis of a detection result of the resistance detecting device.

According to a further aspect of the present invention, there is provided an image forming apparatus according to Claim 5, further comprising a content detecting device configured to detect information on a toner content in the accommodating portion, wherein the first carrier supplying device supplies the carrier liquid to the accommodating portion on the basis of a detection result of the content detecting device.

Further features of the present invention will become apparent from the following description of exemplary embodiments with reference to the attached drawings.

DESCRIPTION OF EMBODIMENTS

First Embodiment

Figure 1:
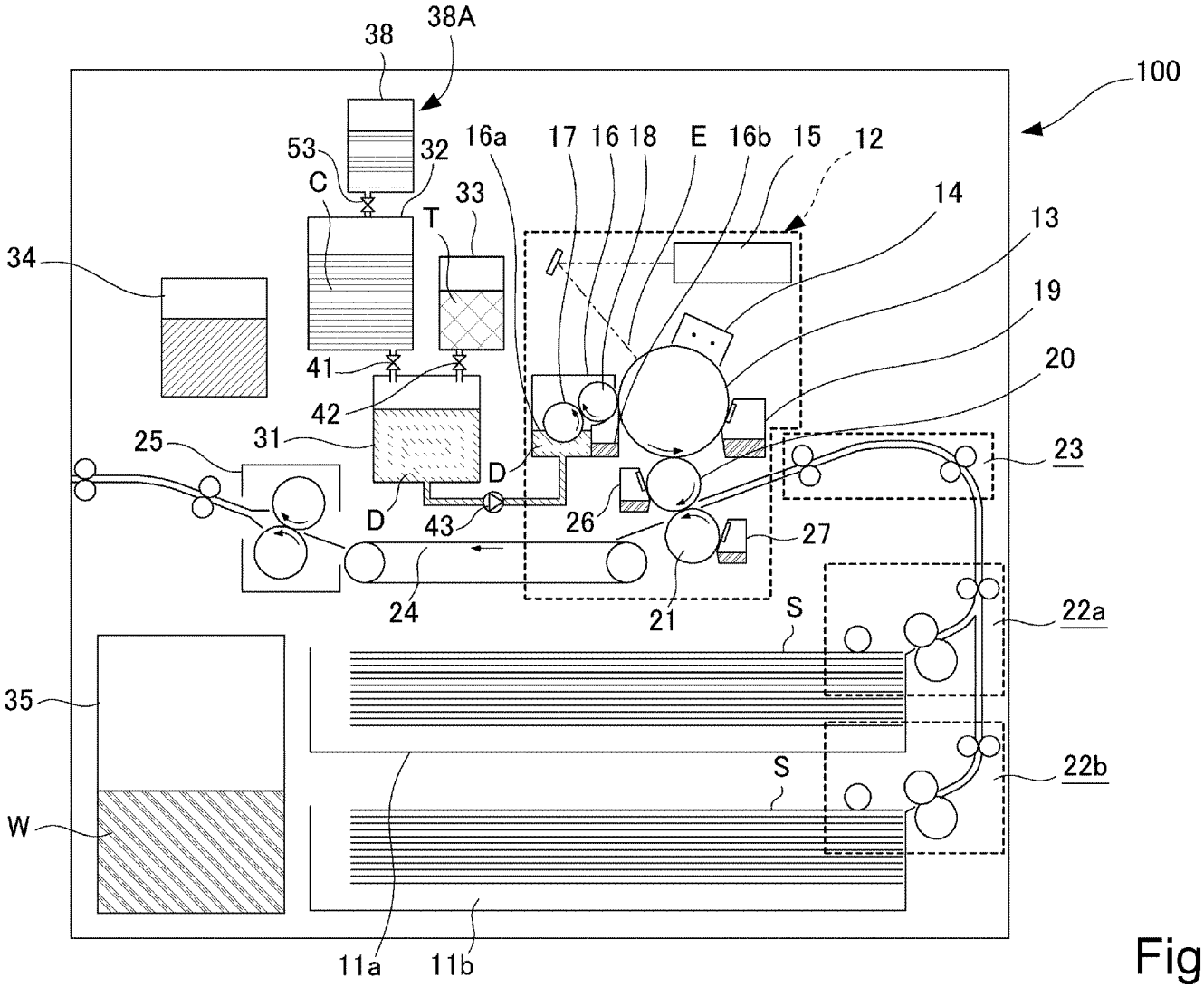
FIG. 1 is a schematic illustration of an image forming apparatus according to a First Embodiment of the present invention.

An embodiment of the present invention will be described using FIGS. 1-12. First, a general structure of an image forming apparatus in this embodiment will be described using FIG. 1.

(Image Forming Apparatus)

An image forming apparatus 100 in this embodiment is a digital printer of an electrophotographic type in which a toner image is formed on a recording material (a sheet, a sheet material such as an OHP sheet and so on). The image forming apparatus 100 is operated on the basis an image signal, and a toner image formed by an image forming portion 12 is transferred onto a sheet as the recording material successively fed from each of cassettes 11*a*, 11*b* and then is fixed on the sheet S, so that an image is obtained. The image signal is sent from an external terminal such as an unshown scanner or an unshown personal computer.

The image forming portion 12 includes a photosensitive drum as an image bearing member, a charger 14, a laser exposure device 15, a developing device 16 and a drum cleaner 19. A surface of the photosensitive drum 13 electrically charged by the charger 14 is irradiated with laser light E from the laser exposure device 15 depending on the first signal, so that an electrostatic latent image is formed on the photosensitive drum 13. This electrostatic latent image is developed as a toner image by the developing device 16. In this embodiment, in the developing device 16, a liquid developer D as a liquid material in which a powdery toner which is a dispersoid is dispersed in a carrier liquid which is a dispersion medium is accommodated, and development is effected using this liquid developer D.

The liquid developer D is generated by mixing and dispersing a toner T in a carrier liquid C in a predetermined ratio in a mixer 31 as a mixing device, and then is supplied to the developing device 16. The carrier liquid C is accommodated in a carrier tank 32 as a carrier container (collecting container), and the toner T is accommodated in a toner tank 33 as a toner container. Then, depending on a mixed state of the carrier liquid C and the toner T in the mixer 31, the carrier liquid C or the toner T is supplied from an associated tank. In the mixer 31, a stirring blade driven by an unshown motor is accommodated, and the developer liquid D is mixed with the carrier liquid C or the toner T by being stirred, so that the toner is dispersed in the carrier liquid.

The liquid developer supplied from the mixer 31 to the developing device 16 is coated (supplied) on a developing roller 18 as a developer carrying member and is used for development. The developing roller 18 carries and feeds the liquid developer D on a surface thereof, and develops with the toner the electrostatic latent image formed on the photosensitive drum 13 (first bearing member). The carrier liquid C and the toner T which remain on the developing roller 18 after the development is collected in a collecting section 16*b* of the developing device 16. Here, each of coating of the liquid developer from a coating roller 17 onto the developing roller 18 and the development of the electrostatic latent image on the photosensitive drum 13 by the developing roller 18 is made using an electric field.

The toner image formed on the photosensitive drum 13 is transferred onto an intermediary transfer roller 20 using the electric field, and then is fed to a nip formed by the intermediary transfer roller 20 and a transfer roller 21. The toner T and the carrier liquid C which remain on the photosensitive drum 13 after the toner image transfer onto the intermediary transfer roller 20 are collected by the drum cleaner 19. Incidentally, at least one of the intermediary transfer roller 20 and the transfer roller 21 may also be an endless belt.

The sheet S accommodated in each of the cassettes 11*a*, 11*b* is fed toward a registration feeding portion 23 by an associated feeding portion 22*a* or 22*b* constituted by feeding rollers. The registration feeding portion 23 feeds the sheet S to the nip between the intermediary transfer roller 20 and the transfer roller 21 by being timed to the toner image transferred on the intermediary transfer roller 20.

In the nip between the intermediary transfer roller 20 and the transfer roller 21, the toner image is transferred onto the sheet S passing through the nip, and the sheet S on which the toner image is transferred is fed to a fixing device 25 by a feeding belt 24, so that the toner image transferred on the sheet S is fixed. The sheet S on which the toner image is fixed is discharged to an outside of the image forming apparatus, so that an image forming step is completed.

The intermediary transfer roller 20 and the transfer roller 21 are provided with an intermediary transfer roller cleaner 26 and a transfer roller cleaner 27, respectively, for collecting the toner T and the carrier liquid C which remain on the associated roller.

(Liquid Developer)

Next, the liquid developer will be described. As the liquid developer D, a conventionally used liquid developer may also be used, but in this embodiment, an ultraviolet-curable liquid developer D is used and will be described below.

The liquid developer D is an ultraviolet-curable liquid developer which contains a cation-polymerizable liquid monomer, a photo-polymerization initiator and toner particles insoluble in the cation-polymerizable liquid monomer. The cation-polymerizable liquid monomer is vinyl ether compound, and the photo-polymerization initiator is a compound represented by the following formula (1).

formula (1)

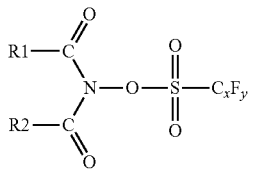

Specifically, first, the toner particles include a colorant and a toner resin material in which the colorant is incorporated. Together with the toner resin material and the colorant, another material such as a charge control agent may also be contained. As a manufacturing method of the toner particles, a well-known technique such as a coacervation in which the colorant is dispersed and a resin material is gradually polymerized so that the colorant is incorporated in the polymer or an internal pulverization method in which a resin material or the like is melted and the colorant is incorporated in the melted resin material may also be used. As the toner resin material, epoxy resin, styrene-acrylic resin or the like is used. The colorant may be a general-purpose organic or inorganic colorant. In the manufacturing method, in order to enhance a toner dispersing property, a dispersant is used but a synergist can also be used.

Next, a curable liquid which is the carrier liquid is constituted by the charge control agent for imparting electric charges to the toner surface, a photo-polymerization agent (initiator) for generating acid by ultraviolet (UV) irradiation and a monomer bondable by the acid. The monomer is a vinyl ether compound which is polymerizable by a cationic polymerization reaction. Separately from the photo-polymerization initiator, a sensitizer may also be contained. By photo-polymerization, a storage property lowers, and therefore a cationic polymerization inhibitor may also be added in an amount of 10-5000 ppm. In addition, a charge control aid, another additive or the like may also be used in some cases.

The UV curing agent (monomer) of the developer is a mixture of about 10% (weight %) of a monofunctional monomer having one vinyl ether group (formula 2 below) and about 90% (weight %) of difunctional monomer having two vinyl ether groups (formula 3 below).

formula 2

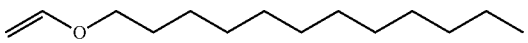

formula 3

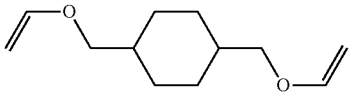

As the photo-polymerization initiator, 0.1% of a compound represented by formula 4 below is mixed. By using this photo-polymerization initiator, different from the case where an ionic photo-acid generator, a high-resistance liquid developer is obtained while enabling satisfactory fixing.

formula 4

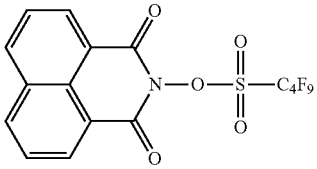

Incidentally, a cationic polymerizable liquid monomer may desirably be a compound selected from the group consisting of dichloropendadiene vinyl ether, cyclohexanedimethanol divinyl ether, tricyclodecane vinyl ether, trimethylolpropane trivinyl ether, 2-ethyl-1,3-hexamediol divinyl ether, 2,4-diethyl-1,5-pentanediol divinyl ether, 2-butyl-2-ethyl-1,3-propanediol divinyl ether, neopentylglycol divinyl ether, pentaerythritol tetravinyl ether, and 1,2-decanediol divinyl ether.

As the charge control agent, a well-known compound can be used. As a specific example, it is possible to use fats and oils such as linseed oil and soybean oil; alkyd resin; halogen polymer; oxidative condensates such as aromatic polycarboxylic acid, acidic group-containing water-soluble dye and aromatic polyamine; metallic soaps such as cobalt naphthenate, nickel naphthenate, iron naphthenate, zinc naphthenate, cobalt octylate, nickel octylate, zinc octylate, cobalt dodecylate, nickel dodecylate, zinc dodecylate, aluminum stearate, and cobalt 2-ethylhexylate; sulfonic acid metal salts such as petroleum acid metal salt and metal salt of sulfosuccinic acid; phospholipid such as lectithin; salicylic acid metal salt such as t-butylsalicylic acid metal complex; polyvinyl pyrrolidone resin; polyamide resin; sulfonic acid-containing resin; and hydroxybenzoic acid derivative.

(Feeding of Liquid Developer)

Figure 2:
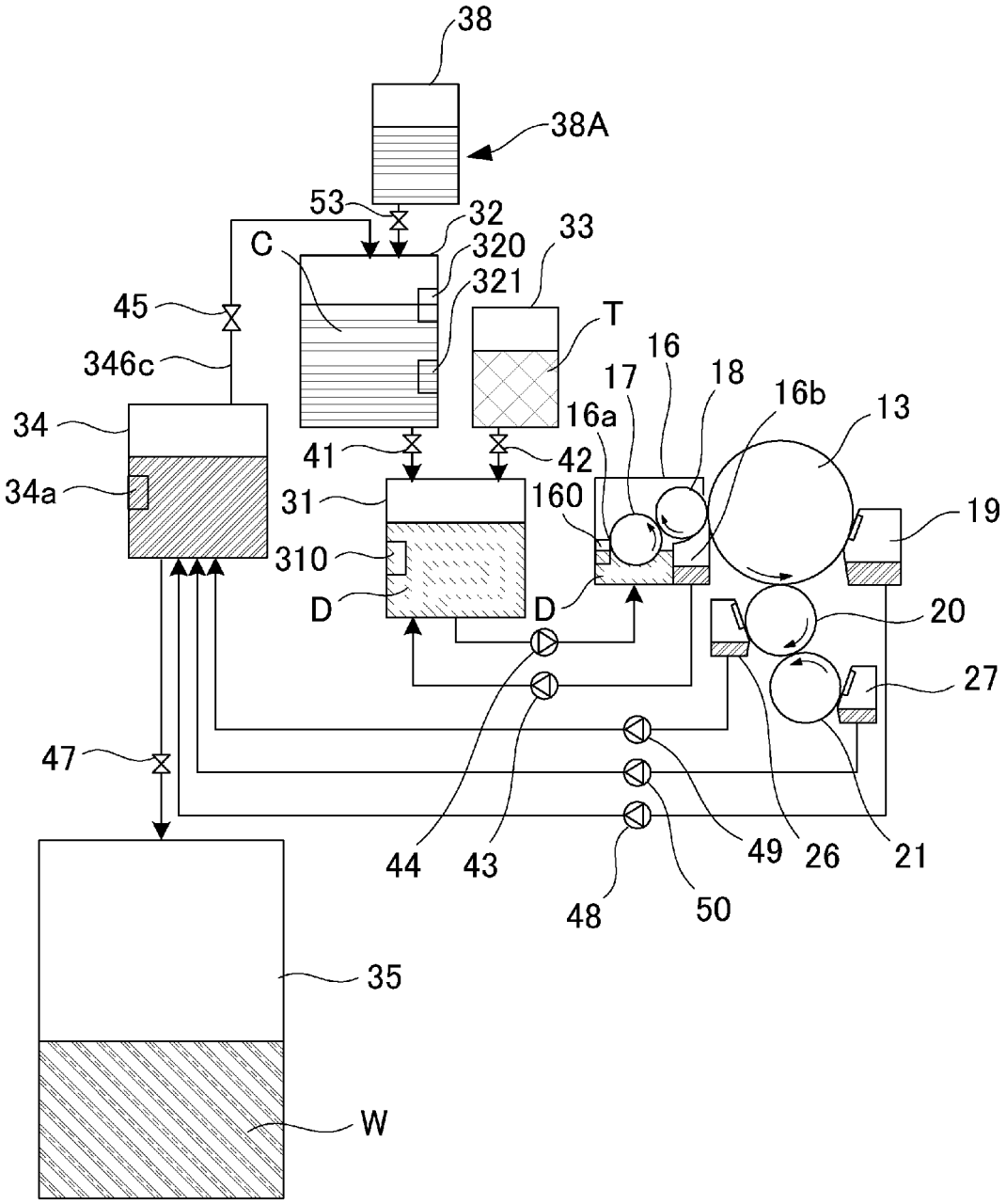
FIG. 2 is a schematic illustration showing a feeding path of a liquid developer in the image forming apparatus in the First Embodiment.

Next, feeding of the liquid developer D in this embodiment will be described using FIGS. 2 to 4. First, as described above, the developer collected at the image forming portion 12 including the drum cleaner 19, the intermediary transfer roller cleaner 26 and the transfer roller cleaner 27 is subjected to separation between the toner and the carrier liquid, so that the carrier liquid is used again. Incidentally, the developer which remains on the developing roller 18 after development and which is collected into the collecting section 16*b* of the developing device is returned to the mixer 31, but may also be fed to a separation and extraction device 34.

Although details will be described later, the separation and extraction device 34 separates a reusable carrier liquid and a waste liquid W containing the toner and an impurity such as paper powder when the carrier liquid and the toner are separated from each other, so that the separated waste liquid W is collected in a waste liquid collecting container 35.

Specifically, a transporting pipe from the carrier tank 32 to the mixer 31 and a transporting pipe from the toner tank 33 to the mixer 31 are provided with electromagnetic valves 41 and 42, respectively, and a supply amount of the carrier liquid C to the mixer 31 and a supply amount of the toner T to the mixer 31 are adjusted. From the mixer 31, the liquid developer D necessary for the development is supplied using a pump 44.

The developer collected in the collecting container 16*b* of the developing device 16 is returned to the mixer 31 by a pump 43. This is because the developer collected in the collecting container 16*b* is little used for the development or the like and therefore is little deteriorated.

The residual carrier liquid and the residual toner which are collected by the drum cleaner 19, the intermediary transfer roller cleaner 26 and the transfer roller cleaner 27 are fed to the separation and extraction device 34 by pumps 48, 49 and 50, respectively.

The reusable carrier liquid separated by the separation and extraction device 34 is fed to the carrier tank 32 by an electromagnetic valve 45. On the other hand, the waste liquid separated by the separation and extraction device 34 is appropriately fed to the waste liquid collecting container 35 by an electromagnetic valve 47 provided to a transporting pipe through self-weight fall. Incidentally, although details will be described later, the carrier liquid is appropriately supplied to the carrier tank 32 by a separating device 38A. The separating device 38A includes a supply carrier tank and an electromagnetic valve 53 provided to a communication pipe for establishing communication between the supply carrier tank 38 and the carrier tank 32.

Transportation of the liquid developer and the like may also be made by, other than the use of the pump, using a feeding type using a self-weight of the liquid developer and the like, for example, in the case where the liquid developer and the like can be fed by the self-weight fall.

Figure 3:
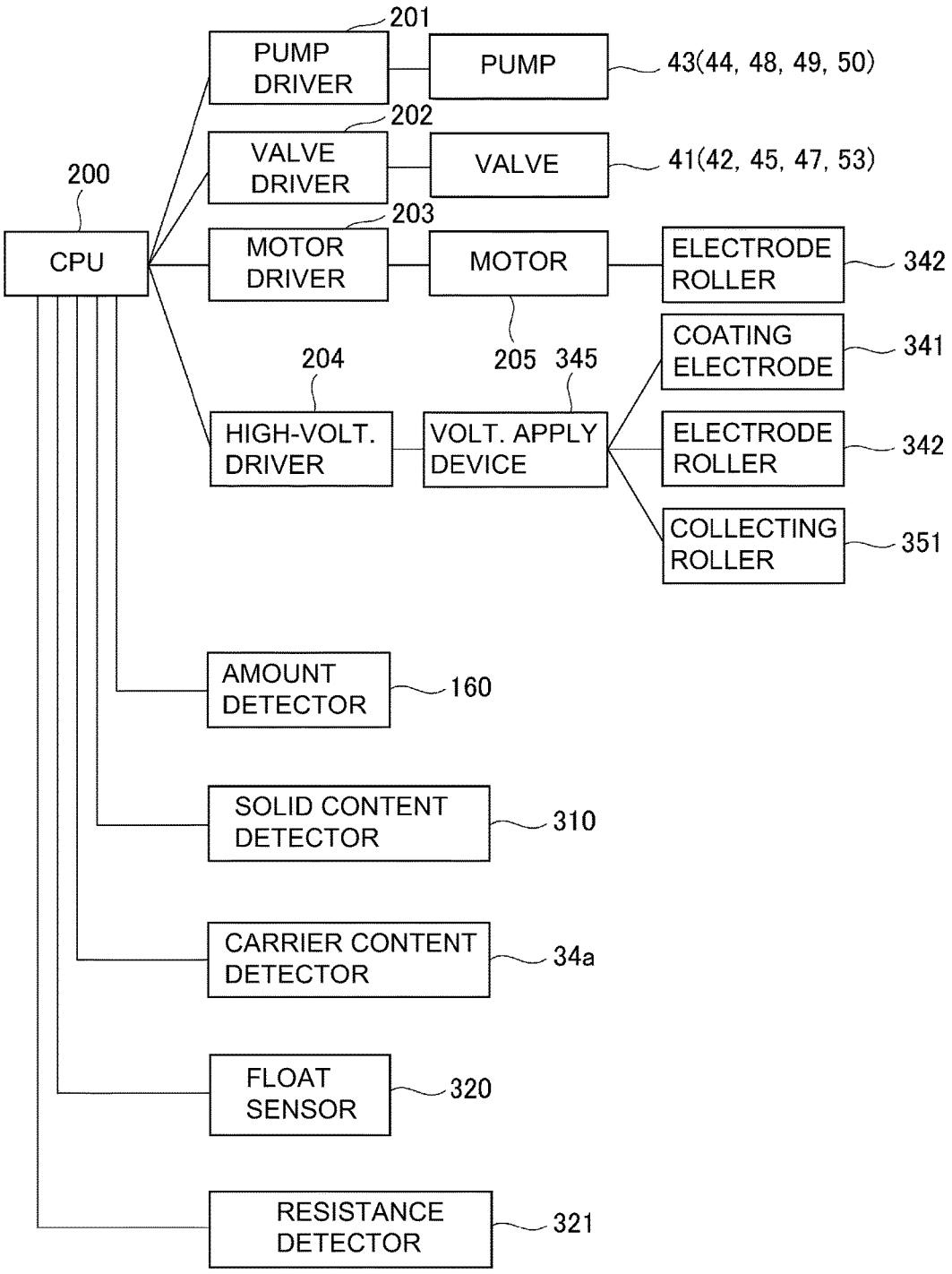
FIG. 3 is a control block diagram of a feeding operation of the liquid developer in the image forming apparatus in the First Embodiment.

As shown in FIG. 3, the above-described pumps 43, 44, 48, 49, 50 and electromagnetic valves 41, 42, 45, 47, 53 are controlled by a CPU 200 as a controller through a pump driver 201 and an electromagnetic valve driver 202, respectively. The CPU 200 controls the respective pumps and the like on the basis of detection values of a developer amount detecting device 160, a solid component content detecting device 310 a carrier liquid content detecting device 34*a*, a float sensor 320 and a carrier liquid resistance detecting device which are described later.

A feeding operation of the liquid developer will be described using FIG. 4 while making reference to FIGS. 2 and 3. First, as shown in FIGS. 2 and 3, the developing device 16 is provided with the developer amount detecting device 160, so that an amount of the liquid developer in the developing device 16 is detected by the developer amount detecting device 160. Further, the mixer 31 is provided with the solid component content detecting device 310 as a content detecting means, so that a content of a solid component such as the toner in the mixer 31 is detected. The solid component content detecting device 310 is, for example, provided with a light-emitting portion and a light-receiving portion, and a portion where the liquid in the mixer 31 passes is irradiated with light from the light-emitting portion and then the light passing through the portion is received by the light-receiving portion. Depending on the amount of the solid component at this portion, a light quantity of the light received by the light-receiving portion changes, and therefore depending on the change in light quantity, the content of the solid component in the mixer 31 can be detected.

Figure 4:
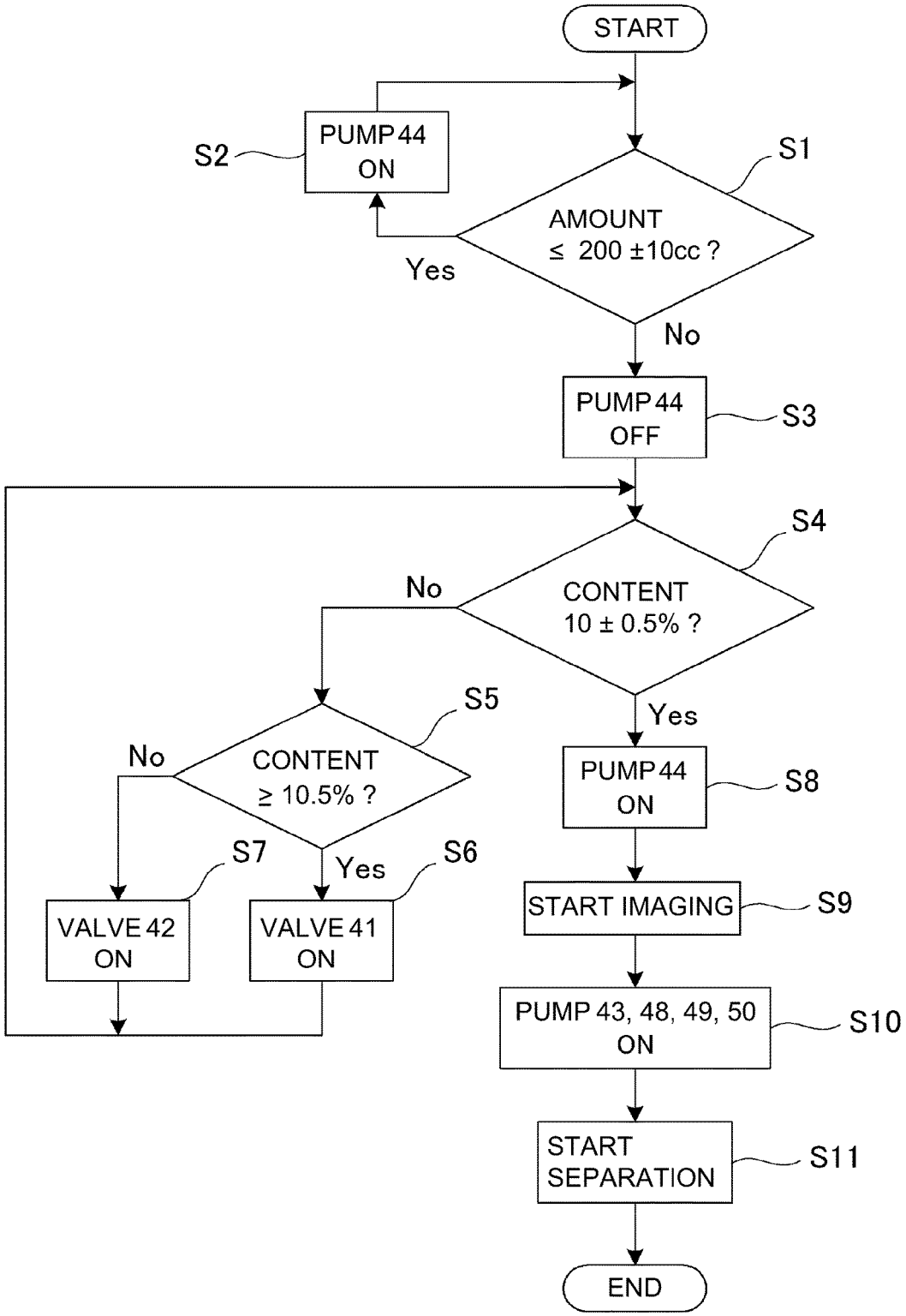
FIG. 4 is a flowchart showing control of the feeding operation of the liquid developer in the image forming apparatus in the First Embodiment.

As shown in FIG. 4, a developer amount in the developing device 16 is detected by the developer amount detecting device 160 (S1). Then, in the case where the developer amount in the developing device 16 is not more than a predetermined amount (e.g., 200±10 cc), the CPU 200 drives the pump 44 (S2), so that adjustment of the liquid developer amount in the developing device 16 is made. After the adjustment, the drive of the pump 44 is stopped (S3).

Then, the content of the solid component in the mixer 31 is detected by the solid component content detecting device 310 (S4). In the case where the content of the solid component in the mixer 31 is out of a predetermined range (e.g., 10±0.5%), the CPU 200 discriminates whether or not the solid component content is 10.5% or more (S5). In the case where the solid component content is 10.5% or more, the electromagnetic valve 41 is opened, so that the carrier liquid is supplied from the carrier tank 32 into the mixer 31 (S6). On the other hand, in the case where the solid component content is not 10.5% or more, i.e., in the case where the solid component content is 9.5% or less, the electromagnetic valve 42 is opened, so that the toner is supplied from the toner tank 33 into the mixer 31 (S7). As a result, content adjustment of the liquid developer in the mixer 31 is made.

That is, in the case where a toner content (solid component content) is high, the carrier liquid is supplied from the carrier tank 32 to the mixer 31 through the electromagnetic valve 41. Further, in the case where the toner content is low, the liquid developer higher in toner content than the liquid developer used in the mixer 31 is supplied from the toner tank 33 to the mixer 31 through the electromagnetic valve 42.

When the solid component content in the mixer 31 falls within the predetermined range, the pump 44 is driven as desired, and then the liquid developer subjected to the content adjustment is supplied from the mixer 31 to the developing device 16 (S8). Then, image formation is started (S9), and at the same time, drive of the pumps 43, 48, 49, 50 is also started (S10), and also drive of the separation and extraction device 34 is started (S11). Incidentally, the separation and extraction device 34 may only be required to be a device capable of performing a separation and extraction process of the toner and the carrier and may also employ a type and a constitution other than those described specifically later.

(Separation and Extraction Device)

Next, using FIGS. 5 to 11, the separation and extraction device 34 as a separating device will be specifically described. The separation and extraction device 34 is a device for separating the liquid developer into the toner and the carrier liquid using the electric field and for separately extracting the carrier liquid and the toner.

Figure 5:
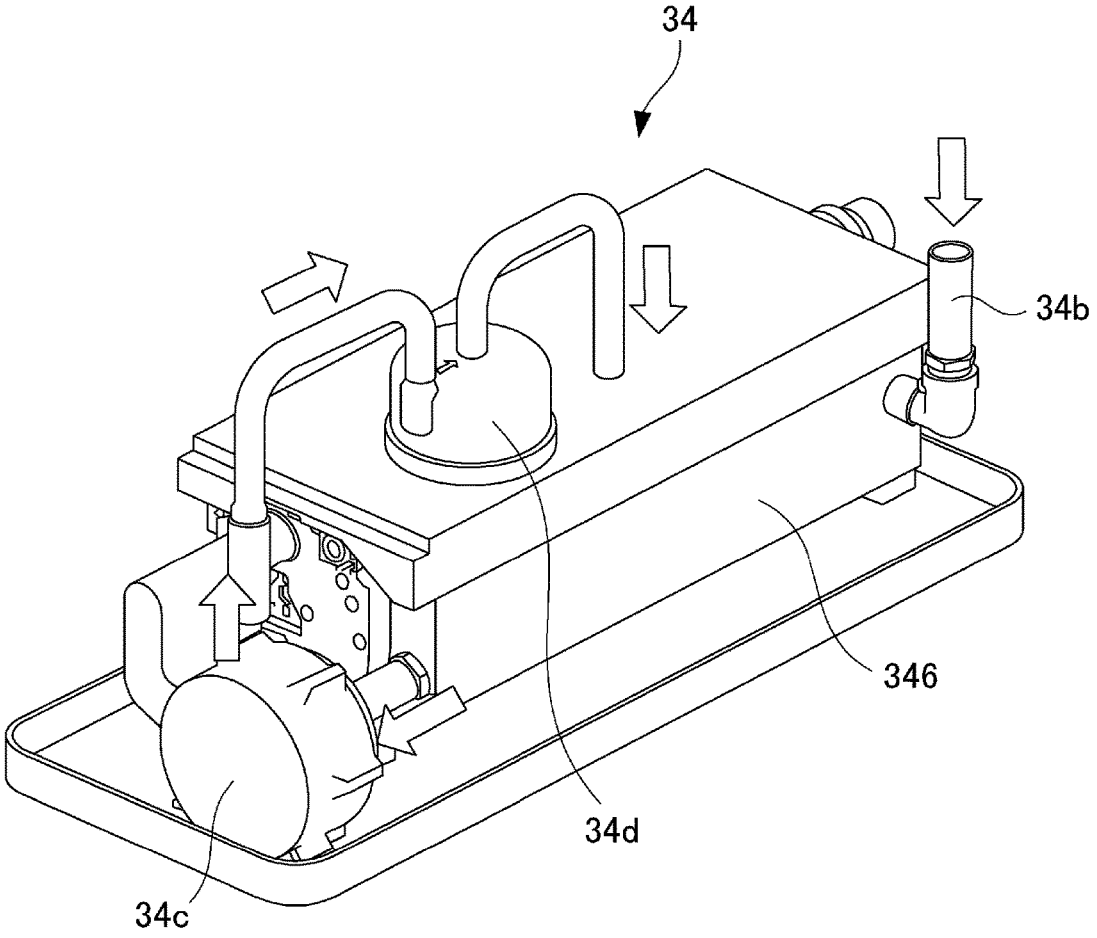
FIG. 5 is a perspective view of a separation and extraction device in the First Embodiment.
Figure 6:
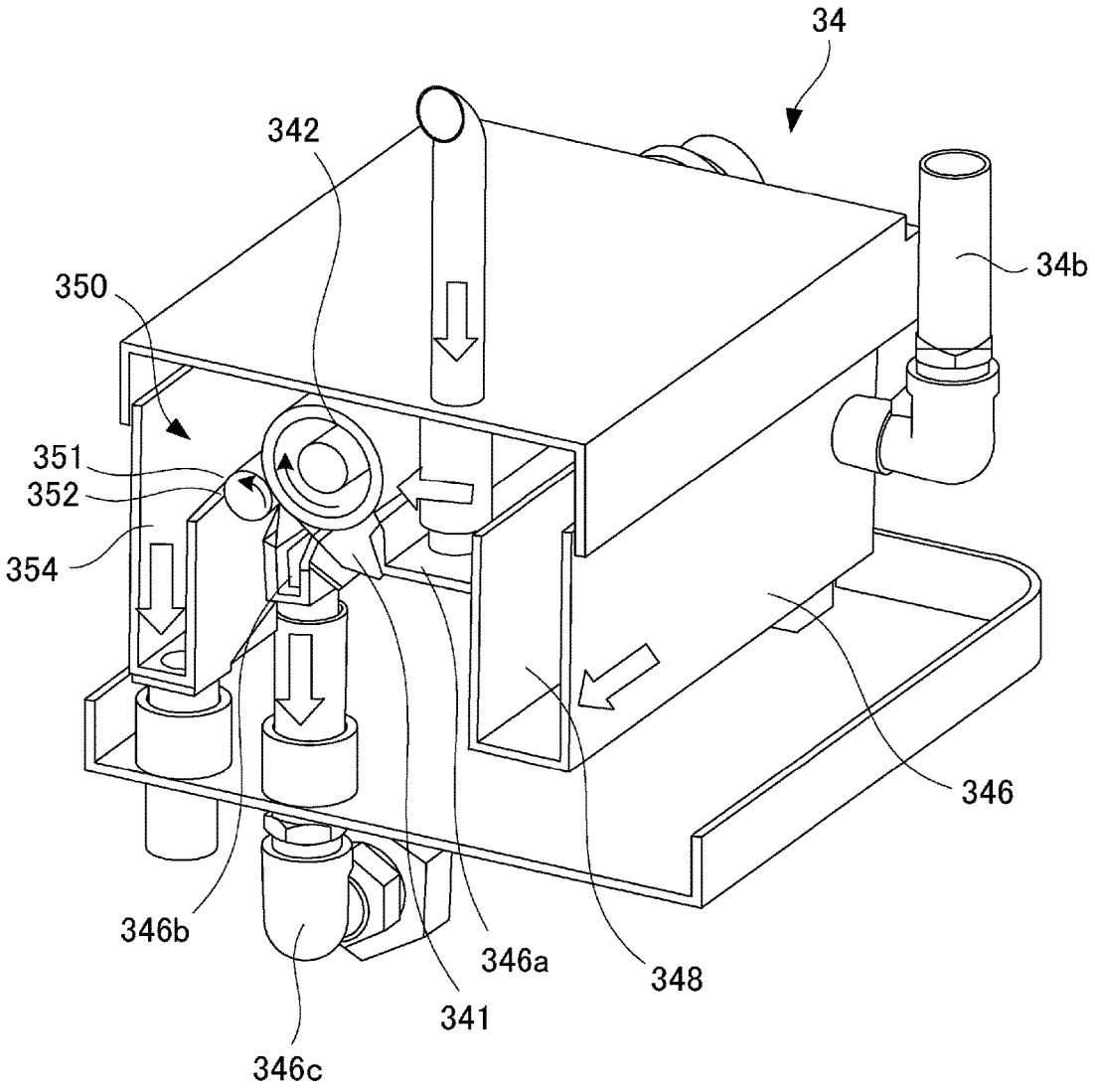
FIG. 6 is a partially cut perspective view showing the separation and extraction device in the First Embodiment.

As described above, the liquid developer collected at the image forming portion 12 such as the drum cleaner 19 is fed from an inlet 34*b* of the separation and extraction device 34 into a liquid accommodating container 346 as shown by arrows in FIGS. 5 and 6. Then, the liquid developer is supplied to a buffer container 348 in the liquid accommodating container 346. In this embodiment, the buffer container 348 is provided in the separation and extraction device 34, but may also be provided separately as a single member. The liquid developer supplied to the buffer container 348 is fed by a pump 34*c* and passes through a filter 34*d*.

The liquid developer passed through the filter 34*d* is poured on a supply tray 346*a* as a supplying portion as shown in FIG. 6. As described later specifically, the liquid developer poured on the supply tray 346*a* is separated into the toner and the carrier liquid by the separation and extraction device 34. Then, the extracted toner is sent to the waste liquid collecting container 35, and the extracted carrier liquid is fed to the carrier tank 32.

Figure 7:
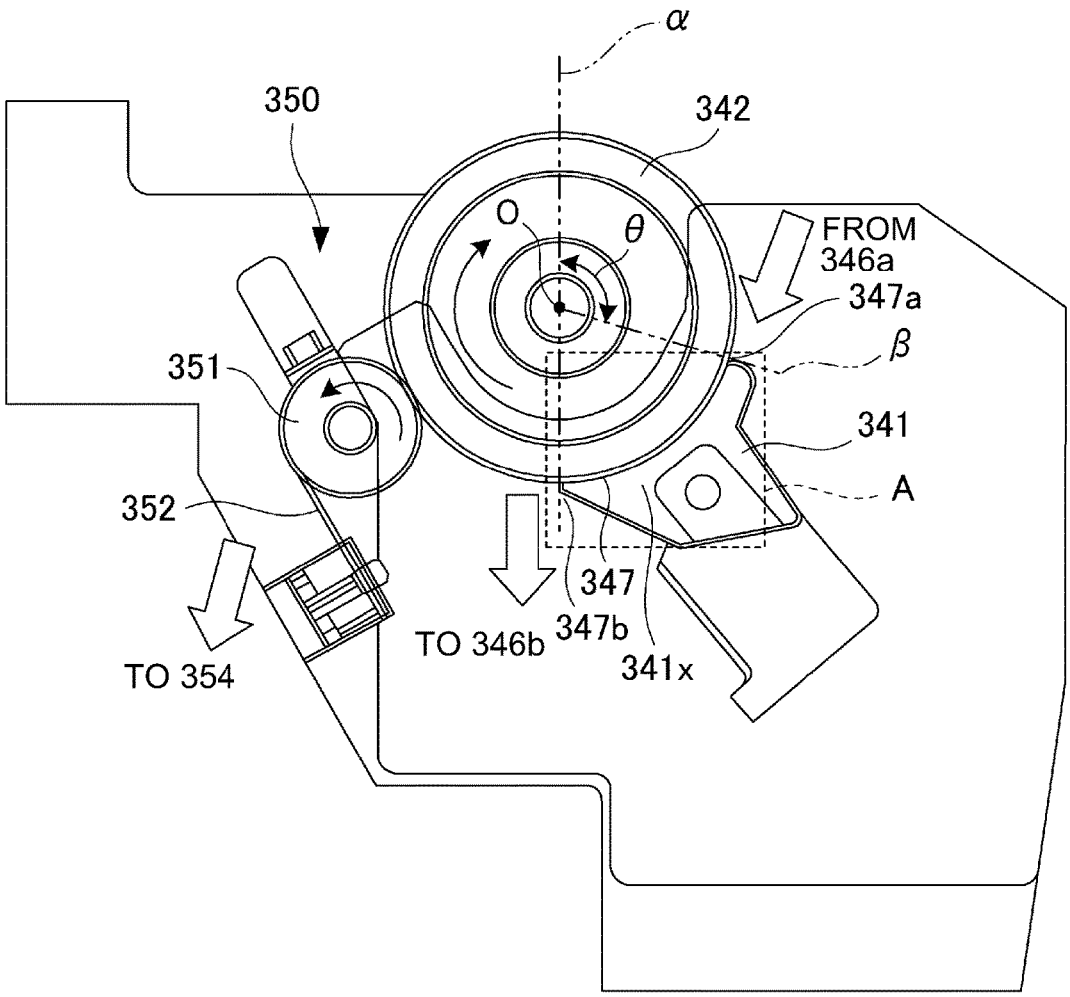
FIG. 7 is a sectional view showing a part of the separation and extraction device in the First Embodiment.

Next, a constitution of separation and extraction of the toner and the carrier liquid in the separation and extraction device 34 will be described. As shown in FIGS. 6 and 7, in the liquid accommodating container 346, a coating electrode member 341 as an external electrode member, an electrode roller 342 as an electroconductive roller, a toner collecting device 350 and the like are provided. The liquid accommodating container 346 is a container capable of accommodating the liquid developer and includes the above-described supply tray 346*a*, a discharge portion 346*b* through which a reusable carrier liquid is to be discharged as described later, and a collecting portion 354 for collecting the developer which is the waste liquid.

The electrode roller 342 is an electroconductive roller which is, for example, formed by integrally molding a core metal, formed with a solid stainless steel material in an outer diameter of 40 mm, with an urethane rubber elastic layer formed on a surface of the core metal. As shown in FIG. 3, a driving force is externally inputted into the electrode roller 342 by a driving motor 205, so that the electrode roller 342 is rotated in a predetermined direction (arrow directions of FIGS. 6 and 7). In this embodiment, a rotational speed of the driving motor 205 is 2000 rpm. Then, the electrode roller 342 is rotated at a rotational speed of, e.g., 400 rpm by reducing the rotational speed of the driving motor 205 by a speed reducer. Incidentally, a voltage applying device 345 is controlled by the CPU 200 through a high-voltage driver 204, and the driving motor 205 is controlled by the CPU 200 through a motor driver 203.

Figure 8:
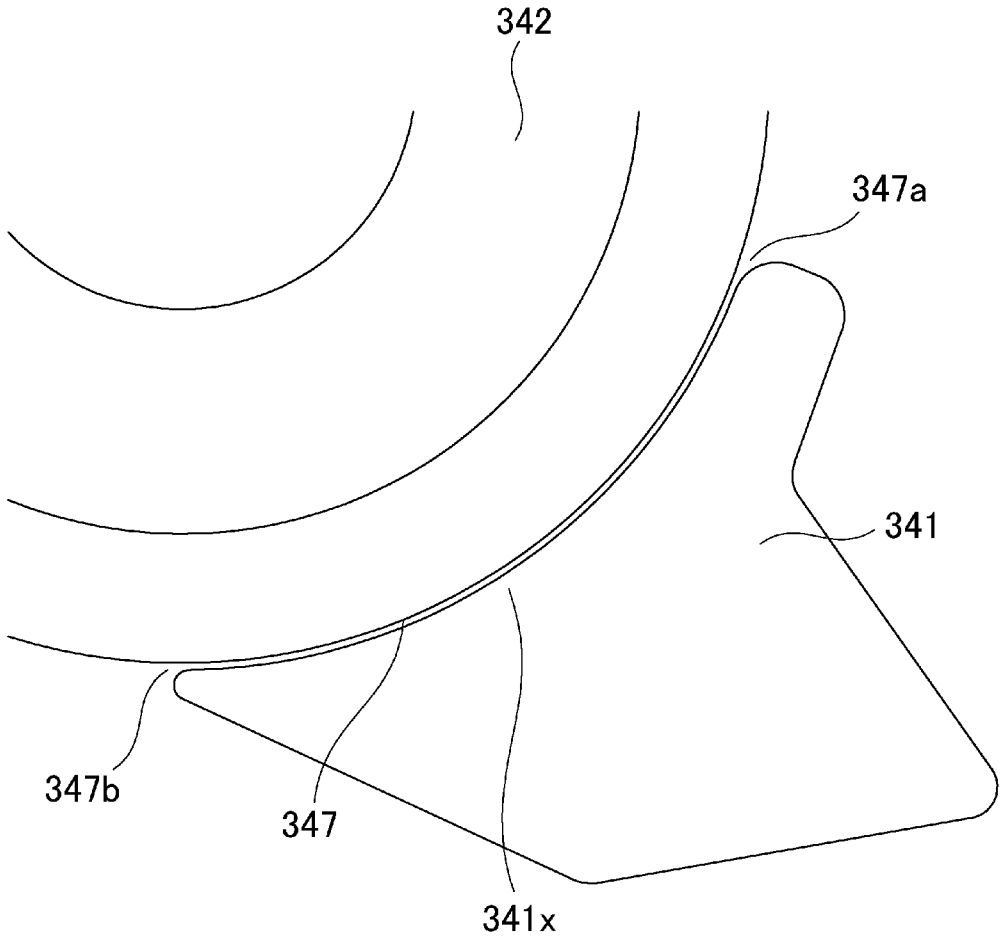
FIG. 8 is an enlarged view of portion A in FIG. 7.

The coating electrode member 341 is disposed with a gap 347 with a part of the electrode roller 342 as shown in FIGS. 7 and 8. With an upstream end portion 347*a* of the gap 347 with respect to a rotational direction of the electrode roller 342, the supply tray 346*a* is connected. Further, the liquid developer poured in the supply tray 346*a* as described above is supplied into the gap 347 through the upstream end portion 347*a*. The gap 347 is sealed at both end portions thereof with respect to a rotational axis direction of the electrode roller 342, so that the liquid developer supplied into the gap 347 is fed through the gap 347 toward a downstream side of the gap 347 with respect to the rotational direction of the electrode roller 342 with rotation of the electrode roller 342. With a downstream end portion 347*a* of the gap 347 with respect to the rotational direction of the electrode roller 342, the discharge portion 346*b* is connected (FIG. 6). Further, the liquid developer passed through the gap 347 is sent to the carrier tank 32 through the discharge portion 346*b* via a transporting pipe 346*c* (FIGS. 2 and 6).

Incidentally, the transporting pipe 346*c* is also connected with a path through which the discharge liquid developer is returned to the separation and extraction device 34 again. The discharge portion 346*b* is provided with the carrier liquid content detecting device 34*a*, so that the toner content in the carrier liquid of the liquid developer sent into the discharge portion 346*b* is detected. A constitution of the carrier liquid content detecting device 34*a* is the same as the constitution of the above-described solid component content detecting device 310. Further, in the case where the toner content of the liquid developer sent to the discharge portion 346*b* is larger than a predetermined value (e.g., 0.02%), the liquid developer is returned to the separation and extraction device 34 again, so that the separation of the liquid developer into the toner and the carrier liquid is effected.

This is because, for example, the case where an abnormal situation such that a power source is shut down during an operation of the separation and extraction device 34 generates and thus the carrier liquid and the toner cannot be sufficiently separated from each other by the separation and extraction device 34 is assumed. In such a case, the toner content of the liquid developer sent to the discharge portion 346*b* is larger than the predetermined value, and therefore in this case, the liquid developer is returned to the separation and extraction device 34. Ordinarily, as described later, the liquid developer passes through the gap 347, so that the toner and the carrier liquid are separated from each other and then the extracted carrier liquid is sent to the discharge portion 346*b*. Accordingly, the toner content of the liquid developer sent to the discharge portion 346*b* is not more than the predetermined value, so that the carrier liquid is sent to the carrier tank 32 without being returned to the separation and extraction device 34. Incidentally, such a path for returning the carrier liquid to the separation and extraction device 34 may also be omitted.

As described above, the coating electrode member 341 disposed opposite to the electrode roller 342 with the gap 347 is formed of an electroconductive material at least at a surface of a portion 341*x* on which the liquid passes through the gap 347. The coating electrode member 341 is formed of, e.g., a solid stainless steel material in width of 400 mm. The portion 341*x* on which the liquid passes has a shape of accommodating a part of the electrode roller 342, and an opposing surface of the portion 341*x* to the electrode roller 342 has a curved shape such that a predetermined distance (i.e., the gap 347) is maintained between the opposing surface and the surface of the electrode roller 342. This predetermined distance is, e.g., 0.2 mm.

As shown in FIG. 3, with the coating electrode member 341 and the electrode roller 342, the voltage applying device 345 as a voltage applying means is connected. Further, between the coating electrode member 341 and the electrode roller 342, a voltage is applied by the voltage applying device 345 so that an electric field for moving the toner toward the electrode roller 342 side. That is, to the gap 347, a voltage such that an electric field for attracting the toner to the electrode roller 342 is generated is applied.

In this embodiment, the toner is negatively charged by the charge control agent, and therefore for example, a voltage of −300 V is applied to the electrode roller 342, and a voltage of −1000 V is applied to the coating electrode member 341. Thus, the toner in the liquid developer passing through the gap 347 is moved from the coating electrode member 341 to the electrode roller 342. As a result, during the passing of the liquid developer through the gap 347, the toner is carried on the electrode roller 342, so that the toner and the carrier liquid are separated from each other. The separated carrier liquid is discharged to the discharge portion 346*b* connected with the downstream end portion 347*b* of the gap 347, and then is sent to the carrier tank 32 as a collecting container as described above.

The toner collecting device 350 is positioned downstream of the coating electrode member 341 with respect to the rotational direction of the electrode roller 342, and collects the toner carried on the electrode roller 342. The toner collecting device 350 including a collecting roller 351, the voltage applying device 345 as a collecting voltage applying means, and a blade member 352 as a scraping member.

The collecting roller 351 is an electroconductive roller formed of, e.g., a solid stainless steel material in an outer diameter of 20 mm, and is provided in contact with the electrode roller 342. Further, the collecting roller 351 contacts the electrode roller 342 and is rotated by the electrode roller 342 in arrow directions of FIGS. 6 and 7. Incidentally, a rotational speed of the collecting roller 351 is, e.g., 800 rpm.

Figure 9:
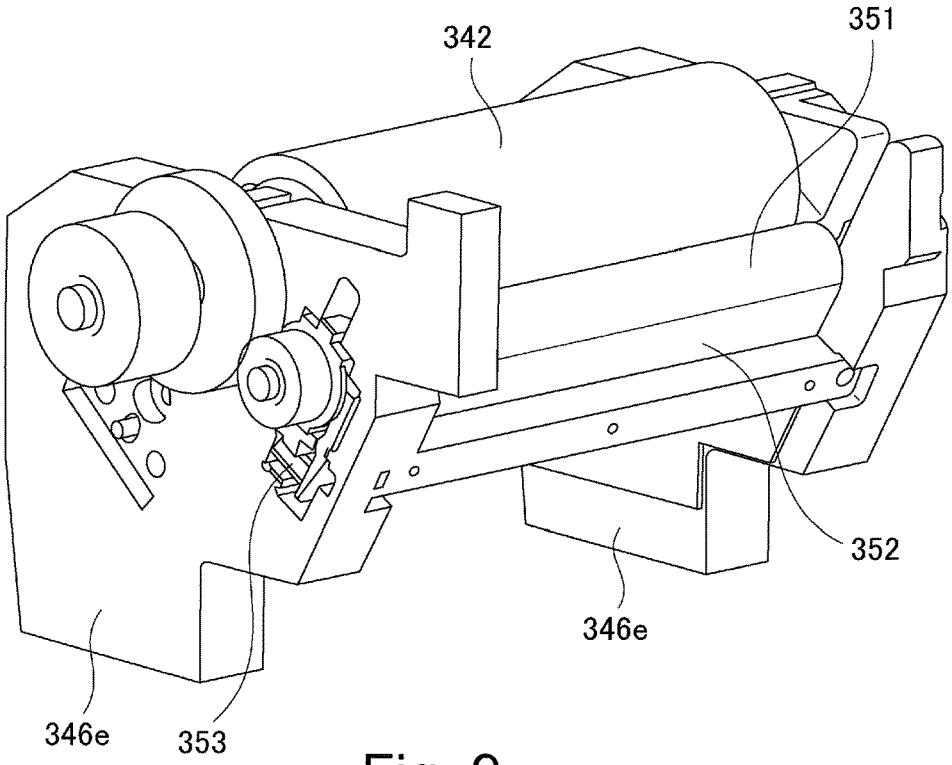
FIG. 9 is a perspective view showing a part of the separation and extraction device in the First Embodiment.
Figure 10:
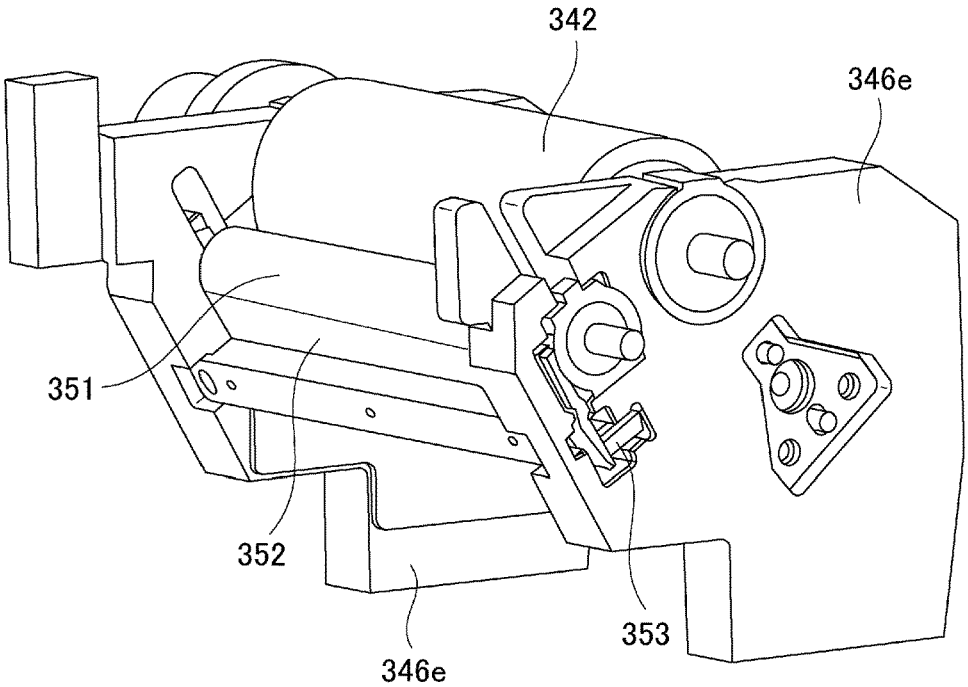
FIG. 10 is a perspective view showing the part of the separation and extraction device in the First Embodiment as seen from an angle different from an angle in FIG. 9.
Figure 11:
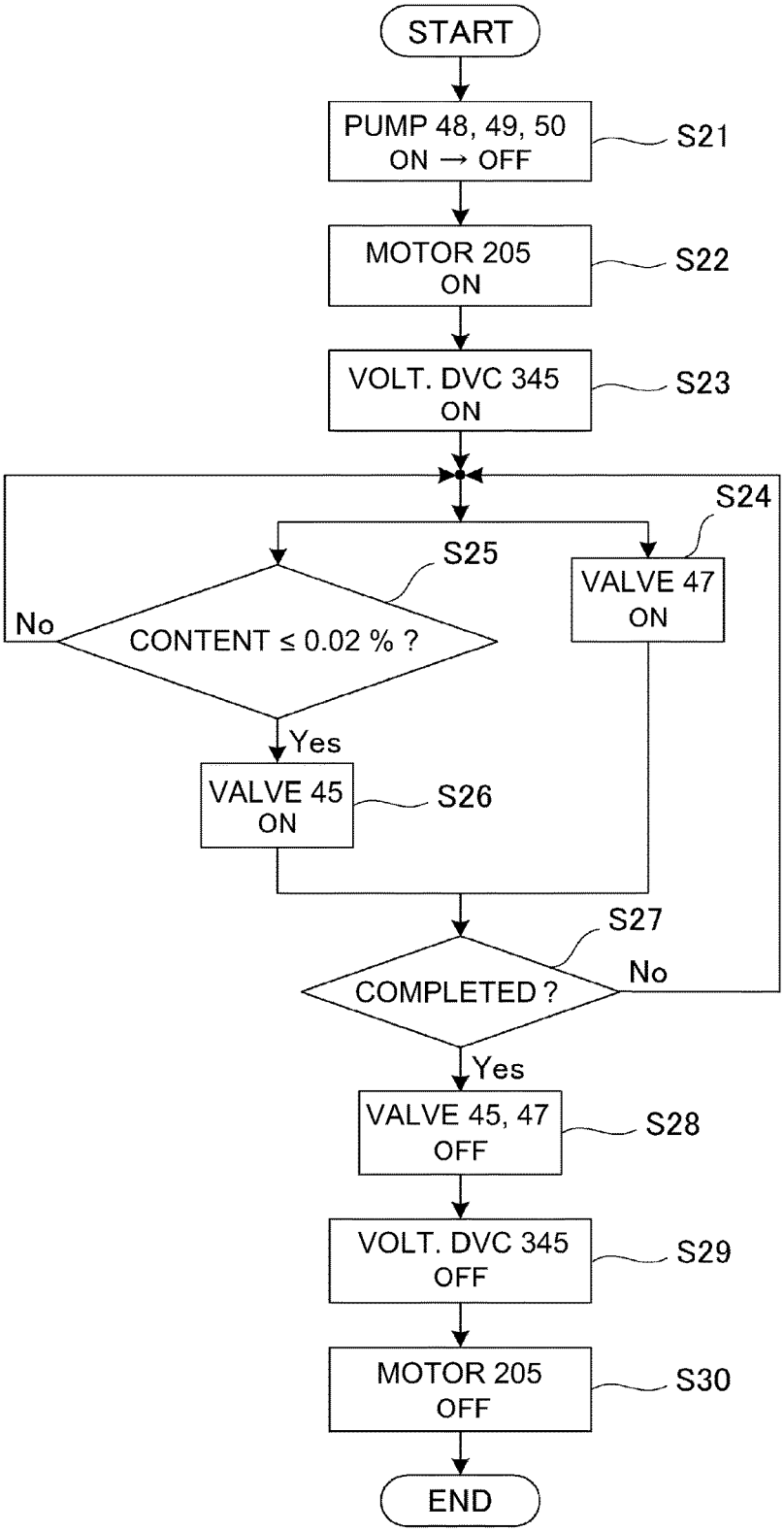
FIG. 11 is a flowchart showing control of a separation and extraction operation of the liquid developer in the First Embodiment.

As shown in FIGS. 9 and 10, the electrode roller 342 and the collecting roller 351 are disposed substantially in parallel to each other, and both end portions of these rollers 342 and 351 with respect to a rotational axis direction are rotatably supported by frames 346*e* constituting the liquid accommodating container 346. At the both end portions of the collecting roller 351, urging mechanisms 353 such as springs are provided. The collecting roller 351 is urged toward the electrode roller 342 by the urging mechanisms 353, so that the electrode roller 342 is elastically deformed. An urging force for urging the collecting roller 351 toward the electrode roller 342 by the urging mechanisms 353 is, e.g., 3 kgf (29.4 N).

The coating electrode member 341 and the collecting roller 351 are positioned on the basis of the electrode roller 342, so that the electrode roller 342 is a positional basis for these members 341 and 351.

The voltage applying device 345 is connected with the electrode roller 342 and the collecting roller 351 as shown in FIG. 3, and applies a voltage to between the collecting roller 351 and the electrode roller 342 so that an electric field for moving the toner toward the collecting roller 351 is generated. In this embodiment, the voltage applying device connected with the electrode roller 342 and the collecting roller 351 and the voltage applying device connected with the electrode roller 342 and the coating electrode member 341 are used in common, but may also be separately provided. In this embodiment, for example, a voltage of −300 V is applied to the electrode roller 342, and a voltage of −200 V is applied to the collecting roller 351. Thus, the toner which is carried on the electrode roller 342 and which is fed toward the collecting roller 351 is moved from the electrode roller 342 to the collecting roller 351.

The blade member 352 solid components off the toner on the collecting roller 351 in contact with the collecting roller 351. The blade member 352 is disposed at a position downstream of a position of contact between the electrode roller 342 and the collecting roller 351 with respect to a rotational direction of the collecting roller 351 so that the blade member 352 contacts the collecting roller 351 with respect to a counter direction to the rotational direction of the collecting roller 351. Incidentally, the counter direction is a direction such that a direction in which the free end portion 352*a* contacting the surface of the collecting roller 351 extends is opposite to a tangential direction along the rotational direction of the collecting roller 351. Further, the blade member 352 is a plate(-like) member extending along a longitudinal direction (rotational axis direction) of the collecting roller 351 and for example, a stainless steel material is used as a material of the collecting roller 351.

As described above, the toner moved from the electrode roller 342 to the collecting roller 351 is scraped off by the blade member 352 and then is sent to the collecting portion 354. The toner collected in the collecting portion 354 is sent to the waste liquid collecting container 35 as described above. Incidentally, a scraping member for scraping the toner off the collecting roller 351 is not limited to the blade member. For example, the blade member may also be formed in a brush shape other than the blade shape. (Positional relation between end portions of gap)

In the case of this embodiment, as described above, the liquid developer which is collected at the image forming portion 12 and which is supplied from the supply tray 346*a* to the gap 347 passes through the gap 347, so that the liquid developer is separated into the toner and the carrier liquid. Here, the liquid flows from above to below along a direction of gravitation. For this reason, it is undesirable that the downstream end portion 347*b* (outlet) through which the liquid developer passed through the gap 347 is to be discharged is positioned above the upstream end portion 347*a* (inlet), through which the liquid developer is to be supplied into the gap 347, with respect to the direction of gravitation.

Particularly, in order to enhance a reuse factor of the carrier liquid, it is preferable that a T/D ratio (mixing ratio between the toner and the carrier liquid) of the developer at the toner scraping portion (contact position of the blade member 352) is increased to the possible extent. However, the liquid developer having a high T/D ratio has a higher viscosity, so that a developer feeding property lowers, and therefore when the outlet of the gap 347 is positioned above the inlet of the gap 347, a recycling efficiency lowers.

Therefore, in this embodiment, as shown in FIG. 7, in the case where a line α passing through a center ○ of the electrode roller 342 and a top of the electrode roller 342 with respect to the direction of gravitation is 0°, the upstream end portion 347*a* of the gap 347 is positioned in a range of 0° or more and less than 180° with respect to the rotational direction of the electrode roller 342. In other words, an angle formed between the line α and a line β passing through the upstream end portion 347*a* of the gap 347 and the center ○ is θ, the upstream end portion 347*a* is positioned so that the angle θ is 0° or more and less than 180°. In a preferred example, the upstream end portion 347*a* of the gap 347 is positioned in a range of 60° or more and 120° or less with respect to the rotational direction of the electrode roller 342. In this embodiment, the upstream end portion 347*a* is positioned in a range from 90° to 120° with respect to the rotational direction of the electrode roller 342.

The downstream end portion 347*b* of the gap 347 is positioned below the upstream end portion 347*a* with respect to the direction of gravitation. In a preferred example, the downstream end portion 347*b* of the gap 347 is positioned in a range of 180° or less with respect to the rotational direction of the electrode roller 342. That is, it is preferable that the downstream end portion 347*b* is positioned in a range which includes the position of 180° and in which the downstream end portion 347*b* is positioned upstream of the position of 180° with respect to the rotational direction of the electrode roller 342. As a result, the liquid developer passing through the gap 347 is prevented from being fed against gravitation, so that the reuse efficiency can be further enhanced. In this embodiment, the downstream end portion 347*b* is in the position of 180° with respect to the rotational direction of the electrode roller 342.

Incidentally, a length of the gap 347, i.e., a length from the upstream end portion 347*a* to the downstream end portion 347*b* along the electrode roller 342 may preferably be not less than ⅕ of a peripheral length of an outer peripheral surface of the electrode roller 342. This length of the gap 347 may also be set depending on the rotational speed of the electrode roller 342. For example, in the case where the rotational speed of the electrode roller 342 is slow, the length of the gap 347 can be shortened. In summary, it is only required that a length in which the toner and the carrier liquid are separated from each other is ensured during the passing of the liquid developer through the gap 347.

(Control Flow of Separation and Extraction Operation of Liquid Developer)

Next, a control flow of a separation and extraction operation of the liquid developer in this embodiment constituted as described above will be described using FIG. 11. First, the respective pumps 48, 49, 50 are driven, so that the developers collected by the drum cleaner 19, the intermediary transfer roller cleaner 26 and the transfer roller cleaner 27 are fed to the separation and extraction device 34. Then, after the developers in a predetermined amount are sent to the separation and extraction device 34, the drive of the pumps 48, 49, 50 is stopped (S21).

Then, the drive of the driving motor 205 is started, so that the electrode roller 342 is rotated (S22). As a result, the liquid developer is fed with rotation of the electrode roller 342. At this time, the collecting roller 351 is rotated by the electrode roller 342. Further, the voltage applying device 345 is turned on (S23). As a result, a voltage is applied to between the coating electrode member 341 and the electrode roller 342 so that an electric field for moving the toner toward the electrode roller 342 is generated, and a voltage is applied to between the collecting roller 351 and the electrode roller 342 so that an electric field for moving the toner toward the collecting roller 351 is generated. For this reason, the toner in the liquid developer is first moved toward the electrode roller 342 and then is moved toward the collecting roller 351. The carrier liquid having no electric charge remains on the coating electrode member 341 side.

That is, the toner T in the liquid developer passing through the gap 347 not only is electrically attracted to the electrode roller 342 but also receives an electrically repelling force from the coating electrode member 341. As a result, the toner T is electrically urged toward the electrode roller 342. Further, the toner which passed through the gap 347 and which was then fed to the collecting roller 351 by the electrode roller 342 not only is electrically attracted to the collecting roller 351 but also receives an electrically repelling force from the electrode roller 342. As a result, the toner is electrically urged in a direction of being spaced from the electrode roller 342, i.e., toward the collecting roller 351.

The toner electrically deposited on the collecting roller 351 is scraped off by the blade member 352. Here, the electromagnetic valve 47 is opened (S24). As a result, the toner scraped by the blade member 352 falls by its own weight and then is collected into the waste liquid collecting container 35 through the collecting portion 354. Incidentally, the toner may be disposed of or reused.

Further, the carrier liquid discharged to the discharge portion 346*b* through the downstream end portion 347*b* of the gap 347 is subjected to detection of the toner content by the carrier liquid content detecting device 34*a*, and whether or not the detected toner content is a predetermined value (e.g., 0.02%) or more is discriminated (S25). When the toner content is the predetermined value or less, the electromagnetic valve 45 is opened, so that the carrier liquid is sent to the carrier tank 32 (S26).

Then, when the separation and extraction of the carrier liquid from the separation and extraction device 34 is completed (S27), the electromagnetic valves 45 and 47 are closed (S28), and the voltage applying device 345 and the driving motor 205 are successively stopped (S29, S30).

Then, the residual developers in a predetermined amount are fed again into the separation and extraction device 34 by the pumps 48, 49, 50, and a subsequent separation process is performed. Thereafter, such an operation is repeated.

In the separation and extraction device 34 in this embodiment, from 100.0 cc of the liquid developer (containing 90.0 cc of the carrier liquid and 10.0 cc of the toner), 88.0 cc of the carrier liquid can be extracted. A required time in one separation process is 30 seconds, for example, and in this case, it is possible to meet a process speed up to 800 mm/s.

(Supply to Carrier Tank)

Figure 12:
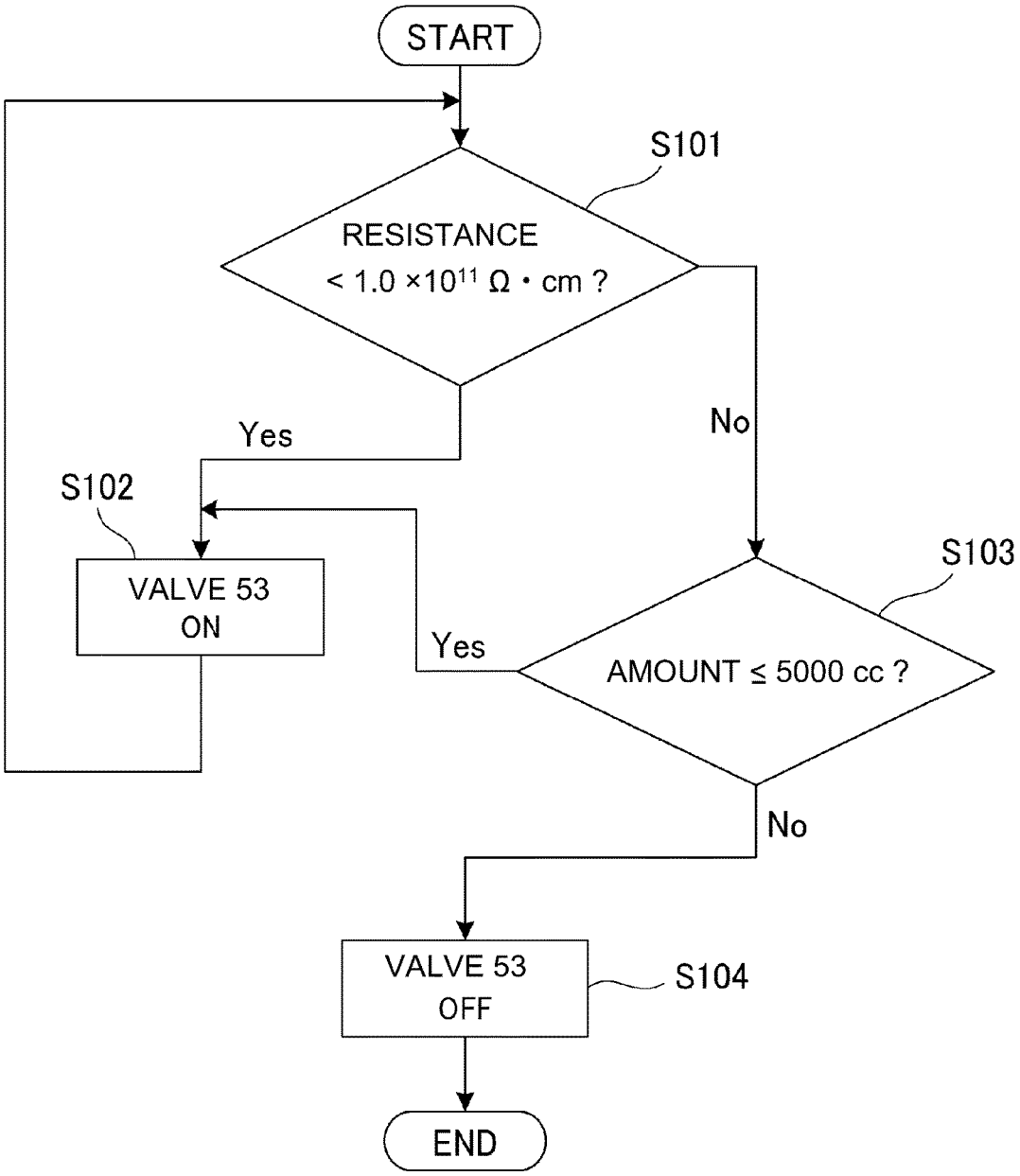
FIG. 12 is a flowchart showing control of a supplying operation of the liquid developer to a carrier tank in the First Embodiment.

Supply of the carrier liquid for supply to the carrier tank 32 by the above-described separating device 38A will be described using FIGS. 2, 3 and 12. As described above, the supplying device 38A for supplying the carrier liquid for supply to the carrier tank 32 is provided. The supplying device 38A includes the supply carrier tank 38 and the electromagnetic valve 53 provided to the communication pipe for establishing communication between the supply carrier tank 38 and the carrier tank 32.

The carrier liquid for supply accommodated in the supply carrier tank 38 is a fresh carrier liquid or a carrier liquid having a high volume resistivity. Such a carrier liquid for supply is higher in volume resistivity than the carrier liquid which is separated and extracted by the separation and extraction device 38 and which is higher in volume resistivity than the carrier liquid used at the image forming portion 12.

The reason why the separating device 38A is provided will be described. In the carrier liquid, by repeating a recycling process, a substance having a low volume resistivity (a low resistance carrier, principally a charge control agent) accumulates. Thus, a resistance o fan entirety of the liquid developer lows, so that there is a liability that an image defect generates. Particularly, in the case where a high content image such as a solid image (which is a toner image formed on an entire surface of the photosensitive member in an image formable region and which refers to the case where an image ratio (print ratio) is 100%), a proportion of the carrier liquid in an output image is small, and therefore particularly the resistance is liable to be lower. In this embodiment, in order to suppress such a lowering in volume resistivity of the carrier liquid, the separating device 38A is provided.

Specifically, as described above, the charge control agent is contained in the carrier liquid accommodated in the carrier tank 32 or in the carrier liquid separated by the separation and extraction device 34 and further in the substance forming the carrier liquid used at the image forming portion 12. The volume resistivity (e.g., $1.0\times10^{9}$ Ω·cm) of the charge control agent is lower than the volume resistivity (e.g., $1.0\times10^{12}$ Ω·cm) of the substance other than the charge control agent. Accordingly, the volume resistivity of such a carrier liquid is, e.g., less than $1.0\times10^{12}$ Ω·cm.

For this reason, in this embodiment, as the carrier liquid for supply, for example, a carrier liquid having a high volume resistivity which is not less than the volume resistivity of $1.0\times10^{12}$ Ω·cm is used. Incidentally, the volume resistivity of the carrier liquid from which the charge control agent is removed is, e.g., $1.0\times10^{14}$ Ω·cm. For this reason, as the carrier liquid for supply, for example, a fresh carrier liquid having the volume resistivity of not less than $1.0\times10^{14}$ Ω·cm may also be used.

In the carrier tank 32, the float sensor 320 as a liquid amount detecting means for detecting a liquid amount of the carrier liquid in the carrier tank 32 is provided. The float sensor 320 detects a position (liquid level of a float floated on a liquid surface) and thus detects the liquid amount in the carrier tank 32. As the float sensor, for example, a float sensor in which a float provided with a magnet and a reed switch are provided and a position of the float is detected by the reed switch is used. Incidentally, the liquid amount detecting means may also have a constitution other than such a float sensor.

Further, in the carrier tank 32, a carrier liquid resistance detecting device 321 as a resistance detecting mean for detecting the volume resistivity of the carrier liquid in the carrier tank 32 is provided. The carrier liquid resistance detecting device 321 detects the carrier liquid resistance in such a manner that for example, a pair of electrodes is disposed in the carrier liquid and a current is caused to flow through between the pair of electrodes and then a resistance at that time is detected.

The supplying device 38A supplies the carrier liquid for supply into the carrier tank (carrier container) 32 on the basis of detection results of the float sensor 320 and the carrier liquid resistance detecting device 321. This operation will be described using FIG. 12. First, the volume resistivity of the carrier liquid in the carrier tank 32 is detected by the carrier liquid resistance detecting device 321 (S101). In the case where a detection result is less than a predetermined value (e.g., $1.0\times10^{11}$ Ω·cm), the electromagnetic valve 53 is opened and then the carrier liquid for supply is supplied from the supply carrier tank 38 to the carrier tank 32 (S102).

Then, by the float sensor 320, detection that the liquid level (position) of the carrier liquid in the carrier tank 32 is not more than a predetermined position (e.g., not more than 5000 cc) is made (S103), the electromagnetic valve 53 is opened. Then, the carrier liquid for supplying is supplied from the supply carrier tank 38 to the carrier tank 32 (S102). In the case where the volume resistivity of the carrier liquid in the carrier tank 32 is not less than the predetermined value and the liquid level is higher than the predetermined position, the electromagnetic valve 53 is closed (S104), so that the control is ended. Such control is effected by the CPU 200 (FIG. 3). That is, the detection results of the float sensor 320 and the carrier liquid resistance detecting device 321 are sent to the CPU 200, and then the CPU 200 controls the electromagnetic valve 53 on the basis of the detection results.

Incidentally, the supply of the carrier liquid for supply from the separating device 38A may also be effected on the basis of either one of detection results of the float sensor 320 and the carrier liquid resistance detecting device 321. In this case, the sensor which is not used may also be omitted.

As described above, in the case of this embodiment, the carrier liquid for supply having the volume resistivity higher than the volume resistivity of the carrier liquid separated by the separation and extraction device 34 is supplied from the separating device 38A. For this reason, a lowering in volume resistivity of the carrier liquid to be reused can be suppressed, so that also the generation of the image defect can be suppressed.

That is, in the carrier liquid separated from the toner by the separation and extraction device 34, the charge control agent having the low volume resistivity is contained, and therefore there is a possibility that the carrier liquid in the carrier tank 32 lowers. Thus, in the case where the low-resistance carrier liquid is supplied into the mixer 31 and is used as the liquid developer, there is a possibility that the image defect generates. Therefore, in this embodiment, the carrier liquid for supply having the higher volume resistivity than the carrier liquid separated by the separation and extraction device 34 is supplied from the separating device 38A into the carrier tank 32, so that the lowering in volume resistivity of the carrier liquid in the carrier tank 32 is suppressed. As a result, even when the carrier liquid is supplied from the carrier tank 3 into the mixer 31, the lowering in resistance of the liquid developer can be suppressed, so that the generation of the image defect can be suppressed.

In this embodiment, the carrier tank 32 functions as a first container for accommodating the carrier liquid separated by the separating device 34. Further, the carrier tank 32 and the electromagnetic valve 41 functions as a first carrier supplying device for supplying the carrier liquid from the carrier tank 32 into the mixer 31. Further, in this embodiment, the separating device 38A for supplying the carrier liquid for supplying to the carrier tank 32 functions as a second carrier supplying device. Further, in this embodiment, the mixer 31 functions as an accommodating portion for accommodating the carrier liquid supplied from the carrier tank 32 and for accommodating the toner supplied from the toner tank 33. The pump 43 and the mixer 31 functions as a separating device for supplying the carrier liquid to the developing device 16 as a part of the image forming portion.

Further, in this embodiment, in the case where the carrier liquid amount in the carrier tank 32 is not more than the predetermined amount or the volume resistivity of the carrier liquid is not more than the predetermined value, it is possible to automatically supply the fresh carrier liquid or the carrier liquid having the high volume resistivity. During a period of existence of the carrier liquid which is in an amount not less than the predetermined amount in the carrier tank 39 and which has the volume resistivity not less than a predetermined value, the carrier liquid for supply is not supplied. During this period, a carrier liquid for recycling separated and extracted by the separation and extraction device 34 can be used preferentially, so that a supplying cycle of the carrier liquid for supply can be prolonged.

Incidentally, a constitution in which the supply carrier tank 38 exclusively for supplying the carrier liquid for supply is not provided and the carrier liquid for supply is directly supplied to the carrier tank 32 may also be employed.

<Another Example of First Embodiment>

Figure 13:
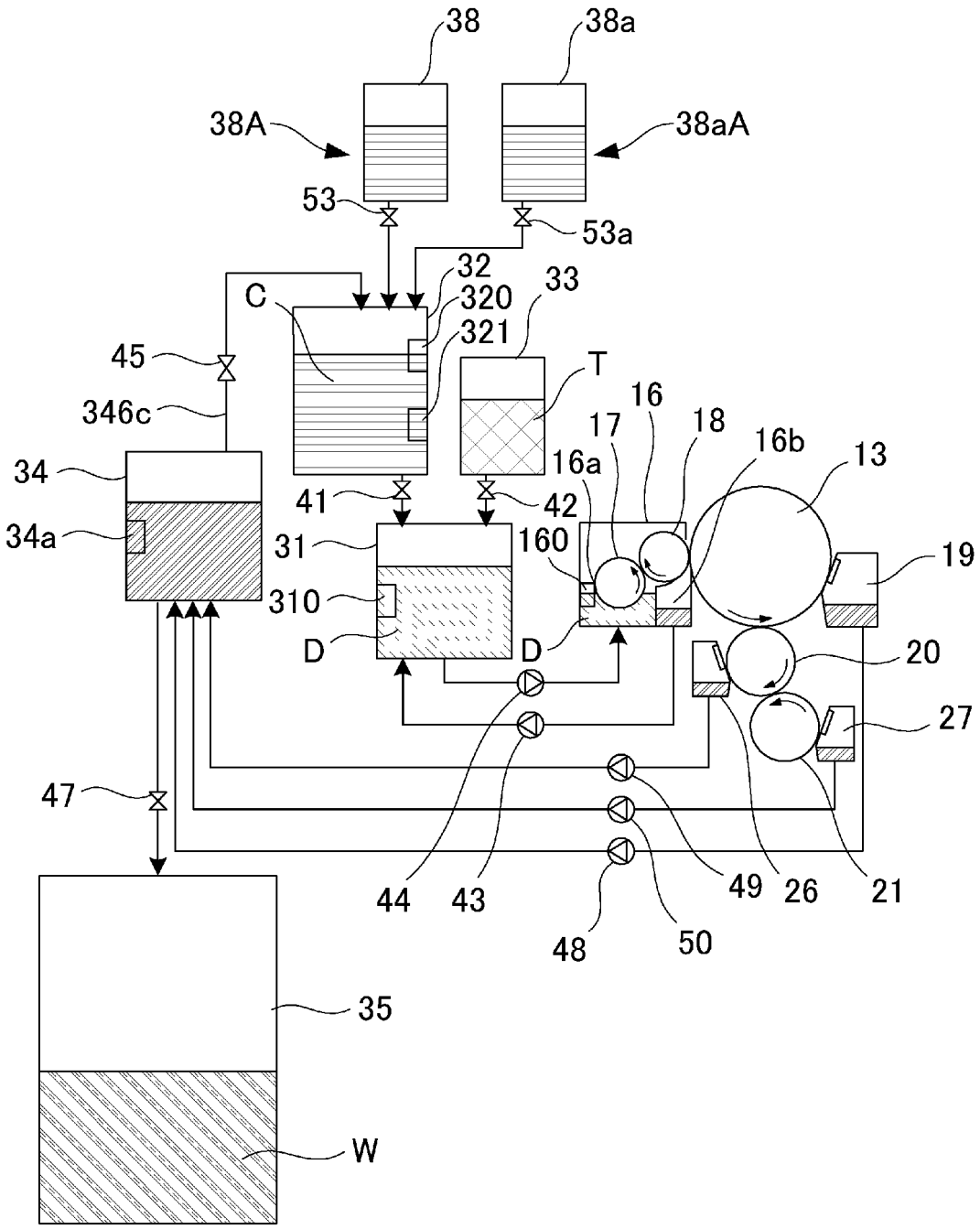
FIG. 13 is a schematic illustration showing a feeding path of a liquid developer in an image forming apparatus according to another example of the First Embodiment.
Figure 14:
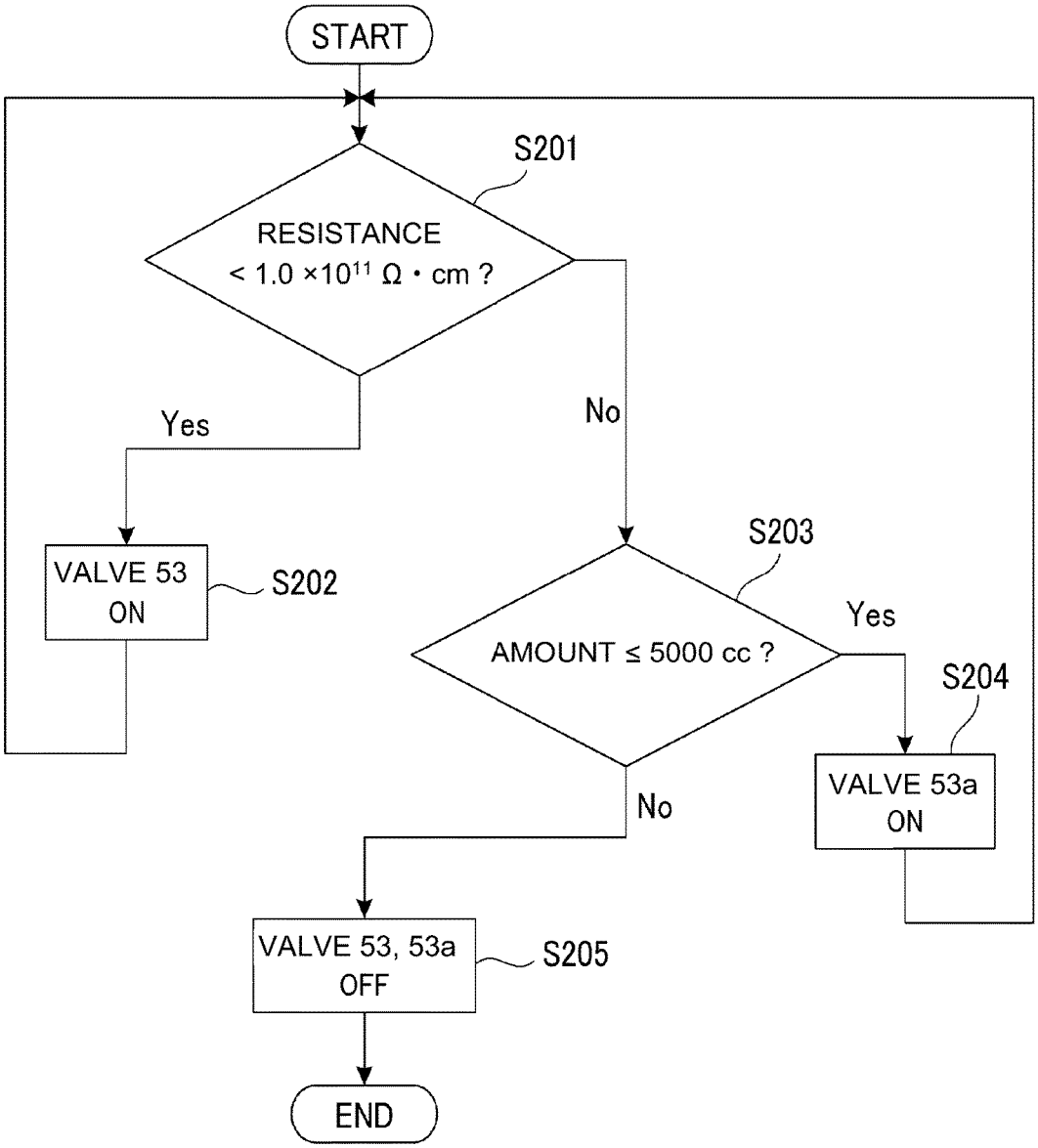
FIG. 14 is a flowchart showing control of a supplying operation of the liquid developer to a carrier tank in another example of the First Embodiment.

Another example of the First Embodiment will be described using FIGS. 13 and 14. In this example, with respect to the constitution of the First Embodiment, as the supplying device for supplying the carrier liquid for supply (fresh carrier liquid or carrier liquid having high volume resistivity) to the carrier tank 32, in addition to the supplying device 38, another supplying device 38*a*A is provided.

Another supplying device 38*a*A includes another supply carrier tank 38*a* and an electromagnetic valve 53*a* provided to a communication pipe for establishing communication between another supply carrier tank 38*a* and the carrier tank 32. Here, the carrier liquid for supply in another supplying device 38*a*A is different in volume resistivity from the carrier liquid for supply in the supplying device 38A. For example, the volume resistivity of the carrier liquid in the supply carrier tank 38 of the supplying device 38A is made higher than the volume resistivity of the carrier liquid in another supply carrier tank 38*a* of another supplying device 38*a*A. Specifically, in the supply carrier tank 38, a fresh carrier liquid (e.g., having the volume resistivity of $1.0\times10^{14}$ Ω·cm or more) containing no charge control agent is accommodated. On the other hand, in another supply carrier tank 38*a*, a carrier liquid which contains a small amount of the charge control agent but which has a high volume resistivity (e.g., $1.0\times10^{12}$ Ω·cm or more) is accommodated. Incidentally, in this embodiment, another separating device 38*a*A functions as a third carrier supplying device. That is, in this embodiment, the carrier tank 32 as the first carrier supplying device, the separating device 38A as the second carrier supplying device, and the separating device 38*a*A as the third carrier supplying device are provided. The separating device 38 and the separating device 38*a*A accommodate the carrier liquids, different in volume resistivity from each other, respectively, and are capable of supplying the carrier liquids to the carrier tank 32.

The supplying device 38A and another supplying device 38*a*A supply the carrier liquid for supply into the carrier tank (carrier container) 32 on the basis of detection results of the float sensor 320 and the carrier liquid resistance detecting device 321. For example, on the basis of a detection result of the carrier liquid resistance detecting device 321, the electromagnetic valve 53 of the supplying device 38A is controlled, and on the basis of the detection result of the float sensor 320, the electromagnetic valve 53*a* of another supplying device 38*a*A is controlled.

This operation will be described using FIG. 14. First, the volume resistivity of the carrier liquid in the carrier tank 32 is detected by the carrier liquid resistance detecting device 321 (S201). In the case where a detection result is less than a predetermined value (e.g., $1.0\times10^{11}$ Ω·cm), the electromagnetic valve 53 is opened and then the carrier liquid for supply is supplied from the supply carrier tank 38 to the carrier tank 32 (S202).

Then, by the float sensor 320, detection that the liquid level (position) of the carrier liquid in the carrier tank 32 is not more than a predetermined position (e.g., not more than 5000 cc) is made (S203), the electromagnetic valve 53*a* is opened. Then, the carrier liquid for supplying is supplied from another supply carrier tank 38*a* to the carrier tank 32 (S204). In the case where the volume resistivity of the carrier liquid in the carrier tank 32 is not less than the predetermined value and the liquid level is higher than the predetermined position, the electromagnetic valves 53 and 53*a* are closed (S205), so that the control is ended. Such control is effected by the CPU 200 (FIG. 3). That is, the detection results of the float sensor 320 and the carrier liquid resistance detecting device 321 are sent to the CPU 200, and then the CPU 200 controls the electromagnetic valves 53 and 53*a* on the basis of the detection results.

As a result, in the case where the carrier liquid amount in the carrier tank 32 is not more than the predetermined amount or the volume resistivity of the carrier liquid is not more than the predetermined value, it is possible to automatically supply the fresh carrier liquid or the carrier liquid having the high volume resistivity.

Incidentally, the supplying operations of the carrier liquids from the supplying device 38A and another supplying device 38*a*A may also be those other than the above-described supplying operations. For example, on the basis of the detection result of the carrier liquid resistance detecting device 321, the carrier liquid for supply is supplied from another supplying device 38*a*A to the carrier tank 32. Further, on the basis of the detection result of the float sensor 320, the carrier liquid for supply may also be supplied from the supplying device 38A to the carrier tank 32. Or, the supplying operations of the carrier liquids from the supplying device 38A and another supplying device 38*a*A may also be performed simultaneously. That is, on the basis of the detection results of the float sensor 320 and the carrier liquid resistance detecting device 321, both of the electromagnetic valves 53 and 53*a* may also be controlled. Other constitutions and actions are similar to Second Embodiment.

Second Embodiment

Figure 15:
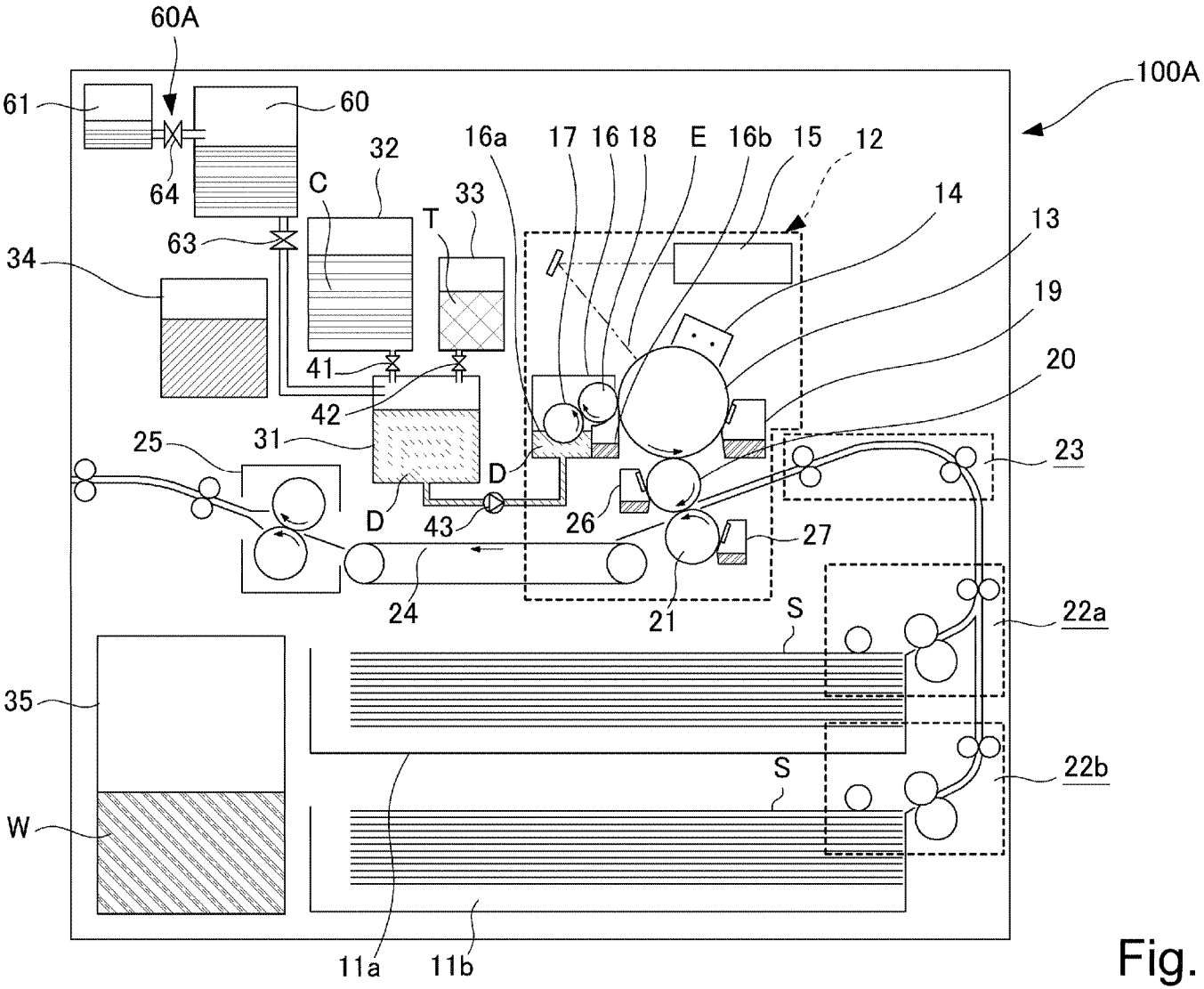
FIG. 15 is a schematic illustration of an image forming apparatus according to a Second Embodiment.

A Second Embodiment of the present invention will be described using FIGS. 15 to 17. In the above-described First Embodiment, the carrier liquid for supply was supplied from the separating device to the carrier tank 32. On the other hand, in an image forming apparatus 100A in this embodiment, the carrier liquid for supply is supplied from a separating device 60A to the mixer 31. Other basic constitutions and actions are similar to those in the First Embodiment, and therefore in the following, the same constitutions will be omitted from description or illustration or will be briefly described, and a portion different from the First Embodiment will be principally described.

Also in the case of this embodiment, the separation and extraction device 34, the carrier tank 32 as the first container for accommodating the carrier liquid separated by the separation and extraction device 34, and the mixer 31 as the second container to which the carrier liquid is supplied from the carrier tank 32 are provided. Further, in this embodiment, a separating device 60A for supplying the carrier liquid for supply to the mixer 31 and a second separating device 61A for supplying the carrier liquid for supply to the supply carrier tank 60 are provided. The separating device 60A includes the supply carrier tank 60 and an electromagnetic valve 63 provided to a communication pipe for establishing communication between the supply carrier tank 60 and the mixer 31. The second separating device 61A includes a supply carrier bottle 61 and an electromagnetic valve 64 provided to a communication for establishing communication between the supply carrier bottle 61 and the supply carrier tank 60.

The carrier liquid for supply accommodated in each of the supply carrier tank 60 and the supply carrier bottle 61 is a fresh carrier liquid or a carrier liquid having a high volume resistivity similarly as in the First Embodiment. Such a carrier liquid for supply is higher in volume resistivity than the carrier liquid which is separated and extracted by the separation and extraction device 38 and which is higher in volume resistivity than the carrier liquid used at the image forming portion 12.

Figure 16:
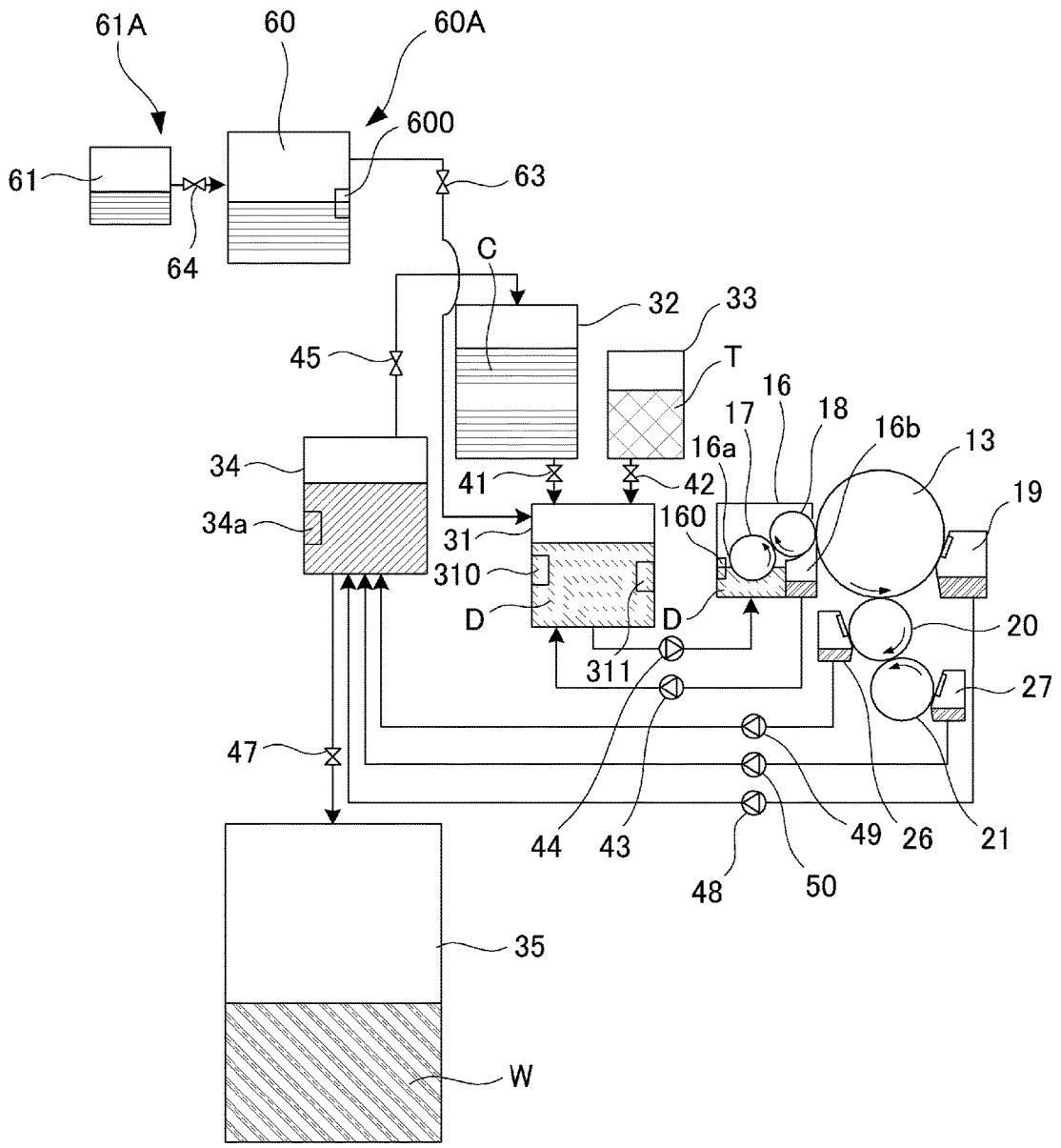
FIG. 16 is a schematic illustration showing a feeding path of a liquid developer in the image forming apparatus in the Second Embodiment.
Figure 17:
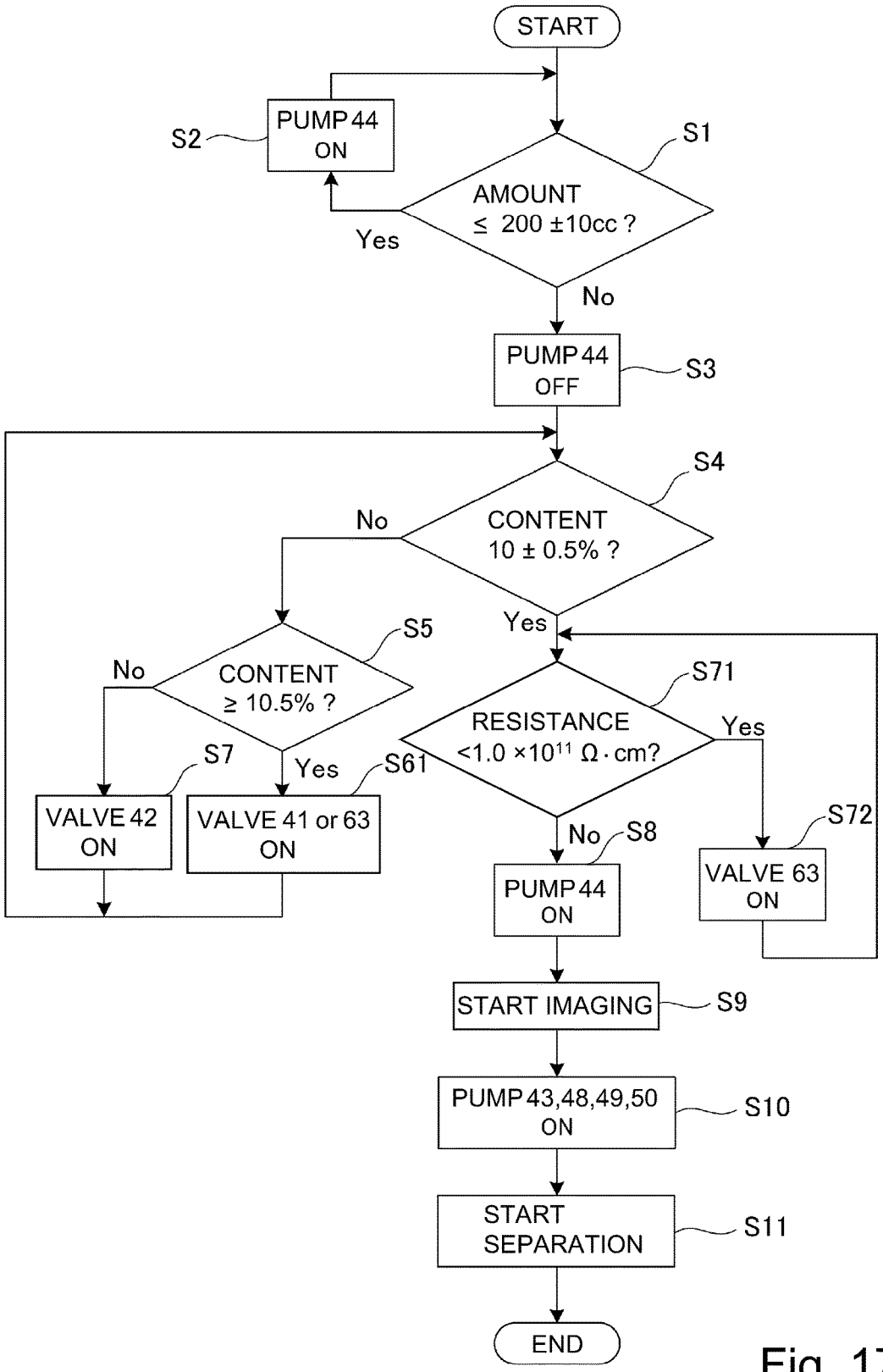
FIG. 17 is a flowchart showing control of a feeding operation of the liquid developer in the image forming apparatus in the Second Embodiment.

As shown in FIG. 16, transporting pipes from the carrier tank 32, the toner tank 33 and the supply carrier tank 60 to the mixer 31 are provided with the electromagnetic valves 41, 42 and 63, respectively, so that amounts of the carrier liquid C and the toner T to the mixer 31 are adjusted. From the mixer 31, the developer D necessary for development is supplied to the developing device 16 by using the pump 44.

In the mixer 31, in addition to the solid component content detecting device 310, a resistance detecting device 311 as a resistance detecting means for detecting the volume resistivity of the liquid developer (liquid) in the mixer 31 is provided. The resistance detecting device 311 detects the volume resistivity by detecting a resistance at the time when, for example, a pair of electrodes is provided in the liquid developer and a current is caused to flow through between the electrodes.

Further, in the supply carrier tank 60, a float sensor 600 as a liquid amount detecting means for detecting a liquid amount of the carrier liquid in the supply carrier tank 60 is provided. The float sensor 600 has the same constitution as that of the above-described float sensor 320.

The separating device 60A supplies the carrier liquid for supply into the mixer (second container) 31 on the basis of a detection result of the resistance detecting device 311 and as desired on the basis of a detection result of the solid component content detecting device 310. Such control is effected by the CPU 200 (FIG. 3). That is, the detection results of the resistance detecting device 311 and the solid component content detecting device 311 are sent to the CPU 200, and then the CPU 200 controls the electromagnetic valve 63 on the basis of these detection results. This operation will be described using FIG. 17. Incidentally, S1 to S3 and S8 to S11 are the same as those in FIG. 4 described above, and therefore will be omitted from description or will be briefly described.

The content of the solid component in the mixer 31 is detected by the solid component content detecting device 310 (S4). In the case where the content of the solid component in the mixer 31 is out of a predetermined range (e.g., 10±0.5%), the CPU 200 discriminates whether or not the solid component content is 10.5% or more (S5). In the case where the solid component content is 10.5% or more, the electromagnetic valve 41 or 63 is opened, so that the carrier liquid is supplied from the carrier tank 32 or the supply carrier tank 60 into the mixer 31 (S1). In this case, it is preferable that the electromagnetic valve 41 is opened preferentially and thus the carrier liquid is supplied preferentially from the carrier tank 32. The electromagnetic valve 63 is opened, e.g., in the case where the amount of the carrier liquid in the carrier tank 32 is small. As a result, it is possible to suppress a frequency of use of the carrier liquid for supply. Incidentally, the electromagnetic valves 41 and 63 may also be opened simultaneously and thus the carrier liquid may also be supplied from the carrier tank 32 and the supply carrier tank 60.

On the other hand, in the case where the solid component content is not 10.5% or more, i.e., in the case where the solid component content is 9.5% or less, the electromagnetic valve 42 is opened, so that the toner is supplied from the toner tank 33 into the mixer 31 (S7). As a result, content adjustment of the liquid developer in the mixer 31 is made. That is, in the case where a toner content (solid component content) is high, the carrier liquid is supplied from the carrier tank 32 or the supply carrier tank 60 to the mixer 31 through the electromagnetic valve 41 or 63. Further, in the case where the toner content is low, the liquid developer higher in toner content than the liquid developer used in the mixer 31 is supplied from the toner tank 33 to the mixer 31 through the electromagnetic valve 42.

When the solid component content in the mixer 31 falls within a predetermined range, the volume resistivity of the liquid developer in the mixer 31 is detected by the resistance detecting device 311 (S71). Then, when detection that the volume resistivity of the liquid developer in the mixer 31 is less than a predetermined value (e.g., $1.0\times10^{11}$ Ω·cm) is made, the electromagnetic valve 63 is opened and thus the carrier liquid is supplied from the supply carrier tank 60 to the mixer 31 (S72). When the volume resistivity of the liquid developer in the mixer 31 is not less than the predetermined value, the pump 44 is driven as desired, and then the liquid developer subjected to the content adjustment is supplied from the mixer 31 to the developing device 16 (S8).

As a result, in the case where the volume resistivity of the liquid developer in the mixer 31 is less than the predetermined value, it is possible to automatically supply the fresh carrier or the carrier having the high volume resistivity. Incidentally, such a constitution that a sensor, such as the float sensor, for detecting the liquid amount is provided in the mixer 31 and in parallel to or in place of the above-described control, the carrier liquid is supplied from the supply carrier tank 60 on the basis of a detection result of this sensor may also be employed.

On the other hand, into the supply carrier tank 60, the carrier liquid is supplied appropriately from the second separating device 61A. As described above, in the supply carrier tank 60, the float sensor 600 is provided. When by the float sensor 600, detection that the liquid level (position) of the carrier liquid in the supply carrier tank 60 is not more than a predetermined position (e.g., not more than 500 cc) is made, the electromagnetic valve 64 is opened. Then, the fresh carrier liquid or the carrier liquid having the high volume resistivity is supplied from the supply carrier bottle 61 to the supply carrier tank 60.

Such control is effected by the CPU 200 (FIG. 3). That is, the detection result of the float sensor 600 is sent to the CPU 200, and then the CPU 200 controls the electromagnetic valve 64 on the basis of the detection results. As a result, in the case where the amount of the carrier liquid in the supply carrier tank 60 is not more than the predetermined amount, the fresh carrier liquid or the carrier liquid having the high volume resistivity can be automatically supplied.

As described above, in the case of this embodiment, the carrier liquid for supply having the volume resistivity higher than the volume resistivity of the carrier liquid separated by the separation and extraction device 34 is supplied from the separating device 60A. For this reason, a lowering in volume resistivity of the carrier liquid to be reused can be suppressed, so that also the generation of the image defect can be suppressed.

That is, in this embodiment, the carrier liquid for supply having the higher volume resistivity than the carrier liquid separated by the separation and extraction device 34 is supplied from the separating device 60A into the mixer 31, so that the lowering in volume resistivity of the liquid developer in the mixer 31 is suppressed. As a result, the lowering in resistance of the liquid developer can be suppressed, so that the generation of the image defect can be suppressed.

Incidentally, in the above-described Second Embodiment, a constitution in which the supply carrier tank 60 was provided and thus even when the supply carrier bottle 61 became empty, the image forming apparatus was capable of operating without humans in attendance was described. However, a constitution in which only the supply carrier bottle 61 is provided may also be employed.

Third Embodiment

A Third Embodiment of the present invention will be described using FIG. 18. In the above-described embodiments, the constitution including the image forming portion 12 for a single color was described. On the other hand, in this embodiment, a plurality of unshown image forming portions are provided. In this embodiment, four image forming portions capable of forming toner images of colors of yellow (Y), magenta (M), cyan (C) and black (K) are provided, so that a full-color image is formable on a recording material.

Figure 18:
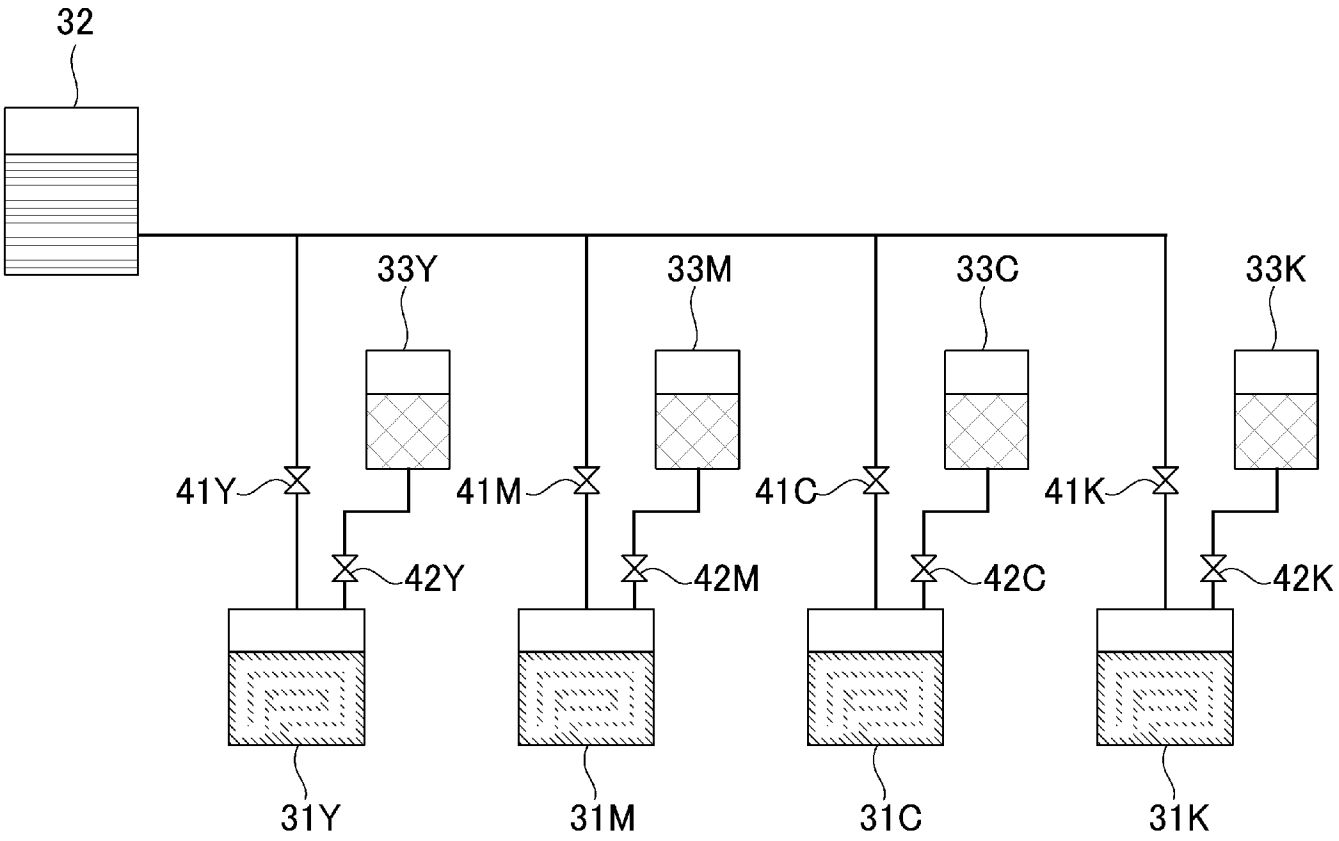
FIG. 18 is a schematic illustration showing a relation of carrier tanks with mixers in a Third Embodiment.

The four image forming portions have the same constitution as the constitution of the image forming portion 12 as shown in FIG. 1, and includes images 31Y, 31M, 31C and 31K, respectively, as shown in FIG. 18. The respective mixers 31Y, 31M, 31C and 31K supply liquid developers of the respective colors to associated ones of developing devices of the respective image forming portions. To the mixers 31Y, 31M, 31C and 31K, toners of the respective colors can be supplied from toner tanks 33Y, 33M, 33C and 33K, respectively. In the respective mixers 31Y, 31M, 31C and 31K, associated solid component content detecting devices are provided, and on the basis of detection results thereof, electromagnetic valves 42Y, 42M, 42C and 42K are controlled, respectively. Thus, the toners are appropriately supplied from the toner tanks 33Y, 33M, 33C and 33K.

On the other hand, a single carrier tank 32 for supplying the carrier liquid to the respective mixers 31Y, 31M, 31C and 31K is provided. That is, the carrier liquid is supplied from the single carrier tank 32 to the respective mixers 31Y, 31M, 31C and 31K. Communication pipes for establishing communication of the single carrier tank 32 with the mixers 31Y, 31M, 31C and 31K are provided with electromagnetic valves 41Y, 41M, 41C and 41K.

The electromagnetic valves 41Y, 41M, 41C and 41K are controlled on the basis of detection results of the carrier liquid resistance detecting devices of the mixers 31Y, 31M, 31C and 31K. Thus, the carrier liquid is appropriately supplied from the single carrier tank 32 to the mixers 31Y, 31M, 31C and 31K.

In this embodiment, the single carrier tank (carrier container) 32, the four mixers (mixing devices) 31Y, 31M, 31C and 31K and the four electromagnetic valves (carrier supplying devices for mixing) 41Y, 41M, 41C and 41K are provided. In other words, commonalty of carrier tanks for the respective image forming portions is achieved. This is because the carrier tanks can be used in common to the respective image forming portions.

Also as regards the separation and extraction device for separating the liquid developers collected at the image forming portions for the respective colors, a single separation and extraction device is employed and is used in common to the image forming portions. Further, also the supply carrier tank 38 and the like described in the above-described embodiments are used in common.

In the case of this embodiment, the carrier tank 32 is used in common for the respective colors, and therefore downsizing and cost reduction of the image forming apparatus can be realized. Further, commonality of the first and second separation and extraction devices and the like is also achieved, so that the downsizing and the cost reduction can be further effectively realized. Other constitutions and actions are similar to those of either one of the above-described First Embodiments.

<Another Example of Third Embodiment>

Figure 19:
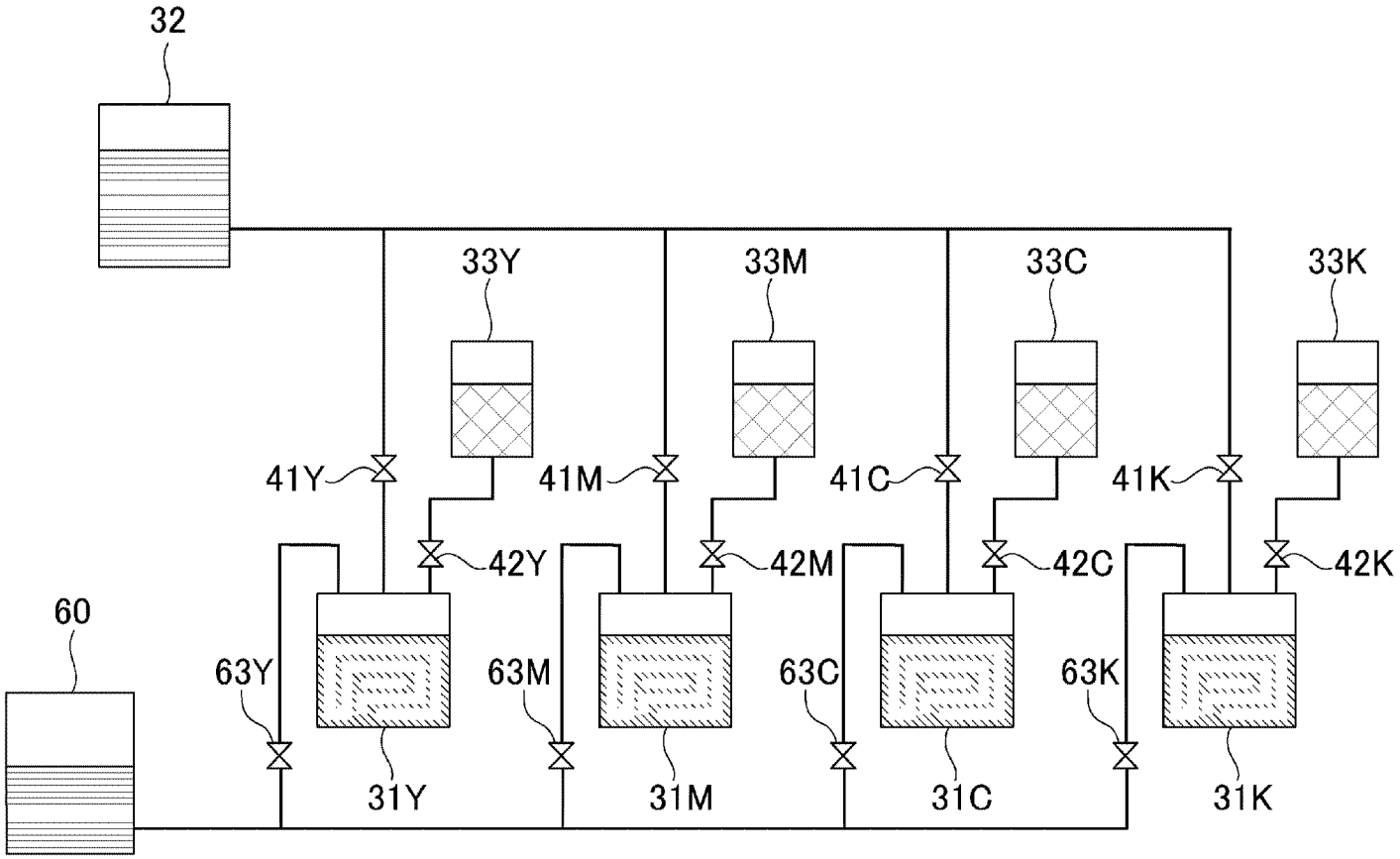
FIG. 19 is a schematic illustration showing a relation of carrier tanks with mixers in another example of the Third Embodiment.

Another example of Third Embodiment will be described using FIG. 19. In the above-described Second Embodiment, the constitution in which the carrier liquid for supply was supplied from the supply carrier tank 60 to the mixer 31 was described. In this example, such a Second Embodiment is combined with the above-described Third Embodiment.

Specifically, a single supply carrier tank (supply container) 60 for supplying the carrier liquid for supply to the respective mixers 31Y, 31M, 31C and 31K is provided. That is, the carrier liquid for supply is supplied from the single supply carrier tank 60 to the respective mixers 31Y, 31M, 31C and 31K. Communication pipes for establishing communication of the single supply carrier tank 60 with the mixers 31Y, 31M, 31C and 31K are provided with electromagnetic valves 63Y, 63M, 63C and 63K.

In each of the mixers 31Y, 31M, 31C and 31K, a resistance detecting device is provided. The electromagnetic valves 63Y, 63M, 63C and 63K are controlled on the basis of detection results of the resistance detecting devices of the mixers 31Y, 31M, 31C and 31K. Thus, the carrier liquid is appropriately supplied from the single supply carrier tank 60 to the mixers 31Y, 31M, 31C and 31K.

In this embodiment, the single supply carrier tank (supply container) 60, the four mixers (mixing devices) 31Y, 31M, 31C and 31K and the four electromagnetic valves (carrier supplying devices for supply) 63Y, 63M, 63C and 63K are provided. In other words, commonalty of supply carrier tanks for the respective image forming portions is achieved. This is because the carrier tanks can be used in common to the respective image forming portions. Incidentally, also the second separating device 61A is used in common to the respective image forming portions.

In the case of this embodiment, the supply carrier tank 60 is used in common for the respective colors, and therefore downsizing and cost reduction of the image forming apparatus can be realized. Other constitutions and actions are similar to those of either one of the above-described Second and Third Embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

INDUSTRIAL APPLICABILITY

According to the present invention, a lowering in volume resistivity of the collect to be reused can be suppressed.

The invention claimed is:

1. An image forming apparatus comprising:

an image forming portion configured to form an image with a liquid developer containing a toner and a carrier liquid, wherein said image forming portion includes a photosensitive member on which a latent image is to be formed, a developing device configured to develop the latent image formed on said photosensitive member into a toner image with the liquid developer, a transfer device configured to transfer the toner image from said photosensitive member onto a recording material, and a cleaning device configured to remove the liquid developer on said photosensitive member after transferring the toner image from said photosensitive member onto the recording material;

a separating device configured to separate the toner and the carrier liquid from the liquid developer collected at said cleaning device;

a first carrier supplying device including a first carrier container configured to accommodate a first carrier liquid separated by said separating device, wherein said first carrier supplying device is capable of supplying the first carrier liquid from said first carrier container;

a second carrier supplying device including a second carrier container configured to accommodate a second carrier liquid which is higher in volume resistivity than the first carrier liquid in said first carrier container, wherein said second carrier supplying device is capable of supplying the second carrier liquid from said second carrier container;

a third carrier supplying device including a third carrier container configured to accommodate a third carrier liquid which is higher in volume resistivity than the first carrier liquid separated by said separating device and which is lower in volume resistivity than the second carrier liquid accommodated in said second carrier container, wherein said third carrier supplying device is capable of supplying the third carrier liquid from said third carrier container;

a liquid amount detecting device configured to detect an amount of the first carrier liquid in said first carrier container; and a resistance detecting device configured to detect a volume resistivity of a liquid in said first carrier container, a toner container configured to accommodate a toner; and an accommodating portion configured to accommodate the liquid developer including the first carrier liquid supplied from said first carrier supplying device, the second carrier liquid supplied from said second carrier supplying device, and the toner supplied from said toner container, wherein the liquid developer accommodated in said accommodating portion is capable of being supplied to said image forming portion, wherein each of said second carrier supplying device and said third carrier supplying device is capable of supplying the carrier liquid to said first carrier container, wherein said second carrier supplying device is capable of supplying the second carrier liquid from said second carrier container to said first carrier container based on a detection result of said resistance detecting device, and wherein said third carrier supplying device is capable of supplying the third carrier liquid from said third carrier container to said first carrier container based on a detection result of said liquid amount detecting device.

2. An image forming apparatus according to claim 1, further comprising:

a toner supplying device capable of supplying the toner to said accommodating portion; and a mixing device configured to mix and disperse the toner, the first carrier liquid, and the second carrier liquid in said accommodating portion.

3. An image forming apparatus according to claim 2, further comprising:

a plurality of toner containers provided correspondingly to a plurality of colors; and a plurality of accommodating portions, provided correspondingly to said plurality of toner containers, to which toner is to be supplied from said plurality of toner containers, wherein said first carrier supplying device is capable of supplying the first carrier liquid to said plurality of accommodating portions.

4. An image forming apparatus according to claim 2, further comprising a content detecting device configured to detect information on a toner content in said accommodating portion, wherein said first carrier supplying device supplies the first carrier liquid to said accommodating portion based on a detection result of said content detecting device.

5. An image forming apparatus according to claim 2, further comprising:

a plurality of toner containers provided correspondingly to a plurality of colors; and a plurality of accommodating portions, provided correspondingly to said plurality of toner containers, to which toner is to be supplied from said plurality of toner containers, wherein said second carrier supplying device is capable of supplying the second carrier liquid from said second container to said plurality of accommodating portions.

6. An image forming apparatus according to claim 1, further comprising a second resistance detecting device configured to detect a volume resistivity of a liquid in said accommodating portion, wherein said second carrier supplying device is capable of supplying the second carrier liquid from said second container to said accommodating portion and supplies the second carrier liquid to said accommodating portion based on a detection result of said second resistance detecting device.

7. An image forming apparatus according to claim 1, wherein the second substance is a curable liquid which is curable by light irradiation.

8. An image forming apparatus according to claim 1, further comprising a fixing device configured to fix the toner image on the recording material by irradiating the toner image, transferred on the recording material, with light to cure the carrier liquid transferred on the recording material.

9. An image forming apparatus according to claim 1, wherein said second carrier supplying device is capable of supplying the second carrier liquid to said first carrier container.

10. An image forming apparatus according to claim 9, wherein said first carrier supplying device is capable of supplying the first carrier liquid in said first carrier container to said accommodating portion.

11. An image forming apparatus according to claim 1, wherein said first carrier supplying device and said second carrier supplying device independently supply the first and second carrier liquids, respectively, to said accommodating portion.

12. An image forming apparatus according to claim 1, wherein the liquid developer accommodated in said accommodating portion is capable of being supplied to said developing device configured to develop the latent image formed on said photosensitive member.

13. An image forming apparatus according to claim 1, wherein the first carrier contains a charge control agent.

14. An image forming apparatus comprising:

an image forming portion configured to form an image with a liquid developer containing a toner and a carrier liquid;

a separating device configured to separate the toner and the carrier liquid from the liquid developer collected at said image forming portion;

a container configured to accommodate the carrier liquid separated by said separating device;

a resistance detecting unit configured to detect volume resistivity of the carrier liquid in said container containing the separated carrier liquid;

a mixing unit configured to mix a carrier liquid for supply higher in volume resistivity than the carrier liquid in said container with the separated carrier liquid; and a control unit configured to control said mixing unit based on the volume resistivity of the carrier liquid in said container, detected by said resistance detecting unit.

15. An image forming apparatus according to claim 14, wherein said control unit controls said mixing unit so as to mix the carrier liquid in said container and the carrier liquid for supply in a case where the volume resistivity of the carrier liquid in said container, detected by said resistance detecting unit, is less than a predetermined value.

16. An image forming apparatus according to claim 14, further comprising a liquid amount detecting unit configured to detect an amount of the carrier liquid in said container, wherein said control unit controls said mixing unit based on the volume resistivity of the carrier liquid in said container, detected by said resistance detecting unit, and the amount of the carrier liquid in said container, detected by said liquid amount detecting unit.

17. An image forming apparatus according to claim 16, wherein said control unit controls said mixing unit so as to mix the carrier liquid in said container and the carrier liquid for supply in a case where the volume resistivity of the carrier liquid in said container, detected by said resistance detecting unit, is less than a predetermined value, wherein said control unit controls said mixing unit so as to mix the carrier liquid in said container and the carrier liquid for supply in a case where the volume resistivity of the carrier liquid in said container, detected by said resistance detecting unit, is the predetermined value or more and where the amount of the carrier liquid in said container, detected by said liquid amount detecting unit, is a predetermined amount or less.

18. An image forming apparatus according to claim 14, wherein the volume resistivity of the carrier liquid for supply is higher than volume resistivity of the carrier liquid used at said image forming portion.

19. An image forming apparatus according to claim 14, wherein the liquid developer is an ultraviolet-curable liquid developer curable by ultraviolet radiation.

* * * * *